US009217990B2

(12) United States Patent
Itabashi

(10) Patent No.: US 9,217,990 B2
(45) Date of Patent: Dec. 22, 2015

(54) IMAGE FORMING APPARATUS HAVING PROCESS CARTRIDGE DETACHABLY MOUNTED THEREIN

(71) Applicant: Nao Itabashi, Nagoya (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 35 days.

(21) Appl. No.: 14/032,228

(22) Filed: Sep. 20, 2013

(65) Prior Publication Data

US 2014/0086625 A1 Mar. 27, 2014

(30) Foreign Application Priority Data

Sep. 21, 2012 (JP) ..... 2012-208918

(51) Int. Cl.
*G03G 21/18* (2006.01)

(52) U.S. Cl.
CPC ..... *G03G 21/1839* (2013.01); *G03G 21/18* (2013.01); *G03G 21/181* (2013.01); *G03G 21/1842* (2013.01)

(58) Field of Classification Search
CPC ..... G03G 21/181
USPC ..... 399/111
See application file for complete search history.

(56) References Cited

U.S. PATENT DOCUMENTS

| | | | | |
|---|---|---|---|---|
| 8,099,013 | B2 | 1/2012 | Okimura et al. | |
| 2005/0249519 | A1* | 11/2005 | Chadez | 399/106 |
| 2008/0310878 | A1 | 12/2008 | Okimura et al. | |

FOREIGN PATENT DOCUMENTS

| | | | |
|---|---|---|---|
| CN | 101329532 | A | 12/2008 |
| CN | 202433692 | U | 9/2012 |
| JP | 2011-133914 | A | 7/2011 |

OTHER PUBLICATIONS

Jun. 30, 2015 (CN) Notification of the First Office Action—App 201310425702.X.

* cited by examiner

*Primary Examiner* — David Gray
*Assistant Examiner* — Michael Harrison
(74) *Attorney, Agent, or Firm* — Banner & Witcoff, Ltd.

(57) ABSTRACT

In an image forming apparatus, a cartridge is detachably mounted in a frame, the cartridge being located at a mounted position in the frame when the image forming apparatus is packaged with the cartridge mounted in the frame, the mounted position being defined in the frame in a mounting direction, in which the cartridge moves relative to the frame so as to be mounted in the frame. An attachment member is detachably attached to the cartridge when the image forming apparatus is packaged with the cartridge mounted in the frame. A restricting mechanism restricts mounting of the cartridge to the mounted position if the attachment member is attached to the cartridge, the restricting mechanism restricting the mounting of the cartridge at a position upstream of the mounted position in the mounting direction.

13 Claims, 15 Drawing Sheets

IMAGE FORMING APPARATUS HAVING PROCESS CARTRIDGE DETACHABLY MOUNTED THEREIN

CROSS REFERENCE TO RELATED APPLICATION

This application claims priority from Japanese Patent Application No. 2012-208918 filed Sep. 21, 2012. The entire content of this priority application is incorporated herein by reference.

TECHNICAL FIELD

The present invention relates to an image forming apparatus of an electrophotographic type.

BACKGROUND

There is known a printer of a type having an apparatus body to which a cartridge is detachably mounted.

There is a demand that the cartridge is included in the printer when the printer is packaged, in order to restrain increase in costs that possibly occurs during shipment and transportation of the printer due to increase in the size of the package.

So, there has been proposed such a printer that is packaged together with a cartridge included in the main body thereof. This printer includes a pressing member for restricting movement of the cartridge relative to the apparatus body of the printer, in order to prevent the cartridge and the apparatus body from contacting and being damaged due to vibrations and impacts that can possibly occur when the package is being shipped and transported. This printer is disclosed in Japanese Patent Application Publication No. 2011-133914, for example.

In order to use the printer, the cartridge has to be removed from the apparatus body of the printer, the pressing member has to be removed from the cartridge, and the cartridge has to be remounted in the apparatus body.

A user possibly forgets to remove the pressing member from the cartridge, before remounting the cartridge in the apparatus body. In such a case, the user remounts the cartridge in the apparatus body while the cartridge is still being attached with the pressing member. Then, the user attempts to close a cover of the apparatus body. However, the cover interferes with the pressing member. So, the user notices that he/she has forgot to remove the pressing member from the cartridge.

SUMMARY

With the above-described conventional configuration, the user first notices that he/she has forgot to remove the pressing member when he/she attempts to close the cover after remounting the cartridge in the apparatus body of the printer.

In such a case, the user has to remove the cartridge again from the apparatus body of the printer, remove the pressing member from the cartridge, and then mounts the cartridge again in the apparatus body of the printer. This requires time and efforts before the user finally becomes able to use the printer.

In view of the foregoing, it is an object of the invention to provide an improved image forming apparatus that can prevent a cartridge from being remounted in the apparatus body if the cartridge is still attached with an attachment member, the attachment member being used for when the image forming apparatus is packaged with a cartridge mounted therein by being attached to the cartridge.

In order to attain the above and other objects, the invention provides an image forming apparatus including: a frame; a cartridge; an attachment member; and a restricting mechanism. The cartridge is configured to be detachably mounted in the frame, the cartridge being located at a mounted position in the frame when the image forming apparatus is packaged with the cartridge mounted in the frame, the mounted position being defined in the frame in a mounting direction, in which the cartridge moves relative to the frame so as to be mounted in the frame. The attachment member is configured to be detachably attached to the cartridge when the image forming apparatus is packaged with the cartridge mounted in the frame. The restricting mechanism is configured to restrict mounting of the cartridge to the mounted position if the attachment member is attached to the cartridge, the restricting mechanism restricting the mounting of the cartridge at a position upstream of the mounted position in the mounting direction.

BRIEF DESCRIPTION OF THE DRAWINGS

The particular features and advantages of the invention as well as other objects will become apparent from the following description taken in connection with the accompanying drawings, in which:

FIGS. 5A and 5B illustrate how the process cartridge shown in FIG. 2 is mounted in and removed from a main casing of the printer, wherein FIG. 5A shows the state when the process cartridge is mounted in the main casing and FIG. 5B shows the state while the process cartridge is being removed from or being mounted into the main casing;

FIGS. 6A and 6B are cross-sectional side views corresponding to the mounted state in FIG. 5A, wherein FIG. 6A shows how the process cartridge, to which the cartridge cover is attached, is mounted in the main casing, and FIG. 6B shows how the process cartridge, from which the cartridge cover has been removed, is mounted in the main casing;

FIGS. 8A and 8B are for a second embodiment, wherein FIG. 8A illustrates how a process cartridge, to which a cartridge cover is attached, is mounted in the main casing of a printer, and FIG. 8B illustrates how the process cartridge, to which the cartridge cover is still attached, is restricted from being remounted in the main casing;

FIGS. 9A-9C are for a third embodiment, wherein FIG. 9A illustrates how a process cartridge, to which a cartridge cover is attached, is mounted in the main casing of a printer, FIG. 9B illustrates how the process cartridge, to which the cartridge cover is still attached, is restricted from being remounted in the main casing, and FIG. 9C is a perspective view of the cartridge cover seen from an upper right side;

FIGS. 10A-10C are for a fourth embodiment, wherein FIG. 10A is a rear view of a process cartridge from which a cartridge cover has been removed, FIG. 10B is a perspective view of the cartridge cover seen from an upper right side, FIG. 10C is a rear view of the process cartridge when the cartridge cover is attached to the process cartridge;

FIGS. 11A-11D illustrate how the process cartridge shown in FIG. 10C is mounted in and detached from the main casing of a printer according to the fourth embodiment, wherein FIG. 11A shows the state when the process cartridge is mounted in the main casing, FIGS. 11B and 11C show the states while the process cartridge is being removed from the main casing, and FIG. 11D shows the state when the process for removing the process cartridge from the main casing has completed;

FIGS. 13A and 13B illustrate how a seal member is mounted in and removed from the process cartridge shown in FIG. 12, wherein FIG. 13A shows the state when the seal member is mounted in the process cartridge, and FIG. 13B shows the state while the seal member is being removed from the process cartridge;

FIGS. 14A-14D illustrate how the process cartridge shown in FIG. 12 is mounted in and detached from the main casing of a printer according to the fifth embodiment, wherein FIG. 14A shows the state when the process cartridge is mounted in the main casing, FIGS. 14B and 14C show the states while the process cartridge is being removed from the main casing, and FIG. 14D shows the state when the process for removing the process cartridge from the main casing has completed.

DETAILED DESCRIPTION

Figure 1:
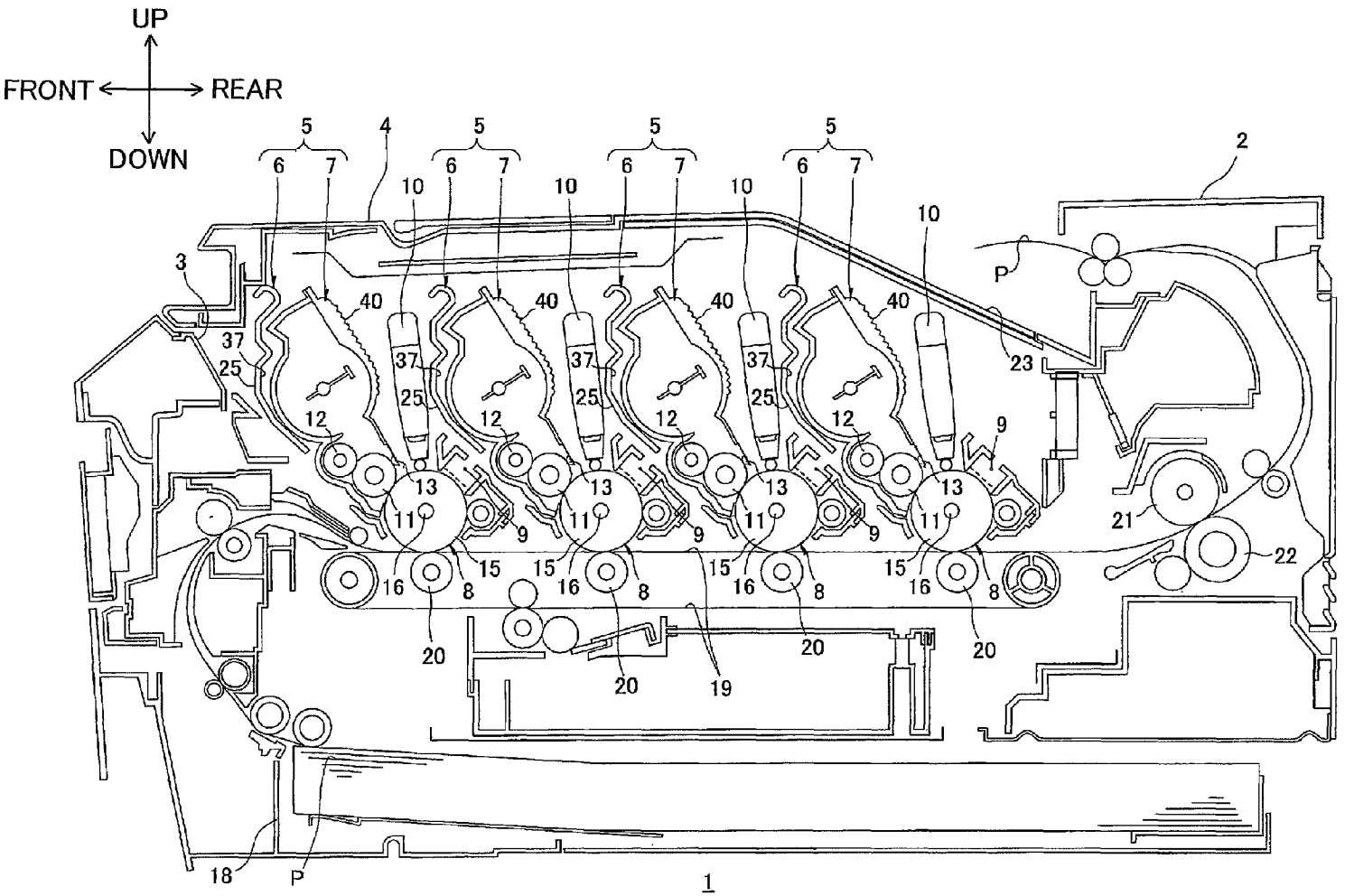
FIG. 1 is a cross-sectional side view of a printer according to a first embodiment of the present invention.

An image forming apparatus according to embodiments of the invention will be described while referring to the accompanying drawings wherein like parts and components are designated by the same reference numerals to avoid duplicating description.

1. Overall Structure of a Printer

FIG. 1 shows a printer 1 according to a first embodiment of the present invention. The printer 1 is a direct horizontal tandem-type color printer. In the following description, directions related to the printer 1 will be given under the assumption that the printer 1 is resting on a level surface, and particularly will correspond to the directions of the arrows indicated in the drawings. More specifically, the upper side in FIG. 1 will be considered as the upper side (one side in the vertical direction) of the printer 1, while the lower side in FIG. 1 will be considered as the lower side (the other side in the vertical direction) of the printer 1. The left side in FIG. 1 will be considered as the front side (one side in the front-rear direction) of the printer 1, while the right side in FIG. 1 will be considered as the rear side (the other side in the front-rear direction) of the printer 1. Left and right sides of the printer 1 will be based on the perspective of a user facing the printer 1 from the front. Thus, the near side in FIG. 1 will be considered as the right side (one side in the left-right direction) of the printer 1, while the far side in FIG. 1 will be considered as the left side (the other side in the left-right direction) of the printer 1.

The printer 1 includes a main casing 2 that has a box-like shape. An access opening 3 is formed in the top portion of the main casing 2. A top cover 4 is pivotably disposed on the top of the main casing 2 over the access opening 3 and is capable of pivoting about its rear edge to expose or cover the access opening 3. The printer 1 also includes a plurality of (four, in this example) process cartridges 5. The process cartridges 5 are all detachably mounted in the main casing 2 through the access opening 3 formed in the top of the main casing 2. The process cartridges 5 are disposed in parallel and spaced at intervals in the front-rear direction. The process cartridges 5 are provided for each of a plurality of (four, in this example) colors (black, yellow, magenta, and cyan).

Each of the process cartridges 5 includes a drum cartridge 6, and a developing cartridge 7 detachably mounted in the drum cartridge 6.

The drum cartridge 6 is provided with a photosensitive drum 8, and a scorotron charger 9.

The photosensitive drum 8 has a cylindrical shape elongated in the left-right direction. The photosensitive drum 8 includes a drum body 15 and a drum shaft 16. A photosensitive layer is formed on a peripheral surface of the drum body 15. The drum shaft 16 extends along a central axis of the drum body 15. The photosensitive drum 8 is rotatably disposed in the lower rear part of the drum cartridge 6.

The scorotron charger 9 is disposed so as to confront the upper rear side of the photosensitive drum 8.

The developing cartridge 7 is provided with a developing roller 11, and a supply roller 12 for supplying toner to the developing roller 11.

The developing roller 11 is elongated in the left-right direction, and is exposed to the rear from the rear edge portion of the cartridge 7. The developing roller 11 is in contact with the upper front side of the photosensitive drum 8.

The supply roller 12 is provided on the upper front side of the developing roller 11, and contacts the developing roller 11.

The developing cartridge 7 also includes a thickness-regulating blade 13 for regulating the thickness of toner carried on the surface of the developing roller 11. The developing cartridge 7 accommodates toner on the upper side of the developing roller 11 and the supply roller 12.

Toner accommodated in the developing cartridge 7 is tribocharged with a positive polarity between the supply roller 12 and developing roller 11, while the thickness-regulating blade 13 maintains the toner carried on the surface of the developing roller 11 at a thin layer of uniform thickness.

In the meantime, the scorotron charger 9 applies a uniform charge to the surface of the photosensitive drum 8. Subsequently, an LED unit 10 disposed in confrontation with the top surface of the photosensitive drum 8 irradiates light onto the surface of the photosensitive drum 8 based on prescribed image data, forming an electrostatic latent image on the surface. Next, the toner carried on the surface of the developing roller 11 is supplied to the latent image formed on the surface of the photosensitive drum 8, developing the latent image into a toner image.

Sheets P of paper are accommodated in a paper tray 18 provided in the bottom section of the main casing 2. Various rollers convey the sheets P along a U-shaped path for redirecting the sheets upward and rearward, and supply the sheets P one at a time between the photosensitive drums 8 and a conveying belt 19 at a prescribed timing. The conveying belt 19 continues to convey each sheet rearward between each of the photosensitive drums 8 and a corresponding transfer roller 20. At this time, toner images of all four colors formed on the photosensitive drums 8 are sequentially transferred onto the sheet P.

The sheet P subsequently passes between a heating roller 21 and a pressure roller 22. The heating roller 21 and pressure roller 22 apply heat and pressure, respectively, to the sheet P for fixing the toner image. Next, the sheet P is conveyed along a U-shaped path that redirects the sheet P upward and forward, and the sheet P is discharged onto a discharge tray 23 provided on the top cover 4.

2. Structure of the Process Cartridges (1) Drum Cartridges

Figure 2:
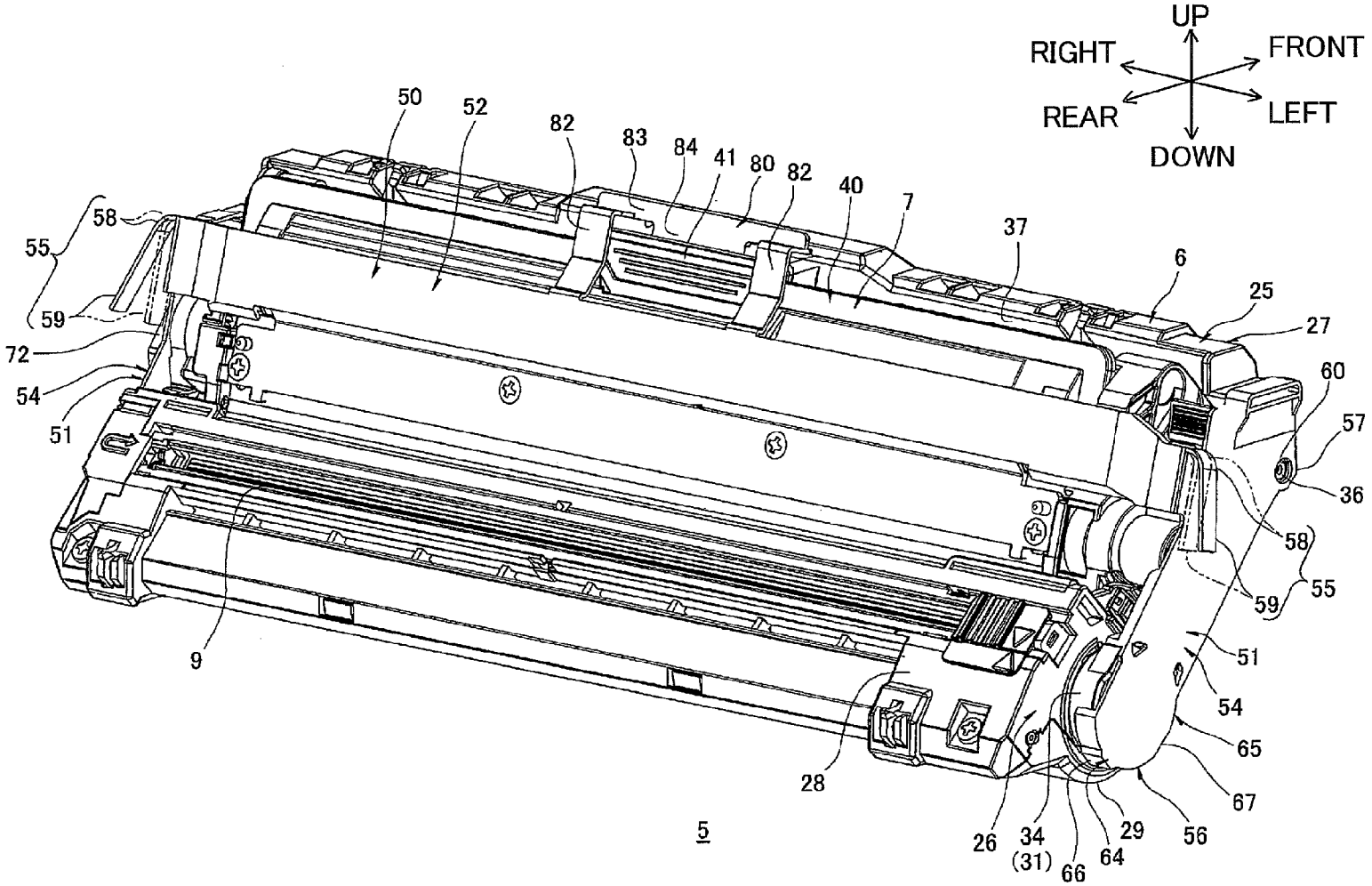
FIG. 2 is a perspective view of the process cartridge shown in FIG. 1 and seen from an upper left side when a cartridge cover is attached to the process cartridge.
Figure 6B:
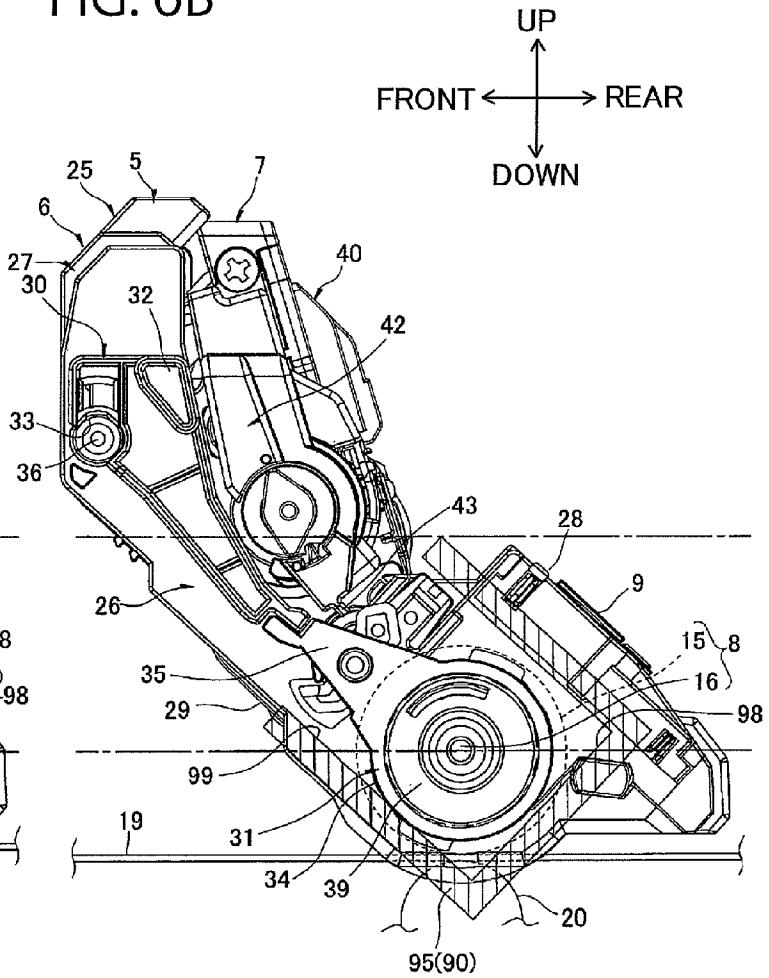
Figure 6A:
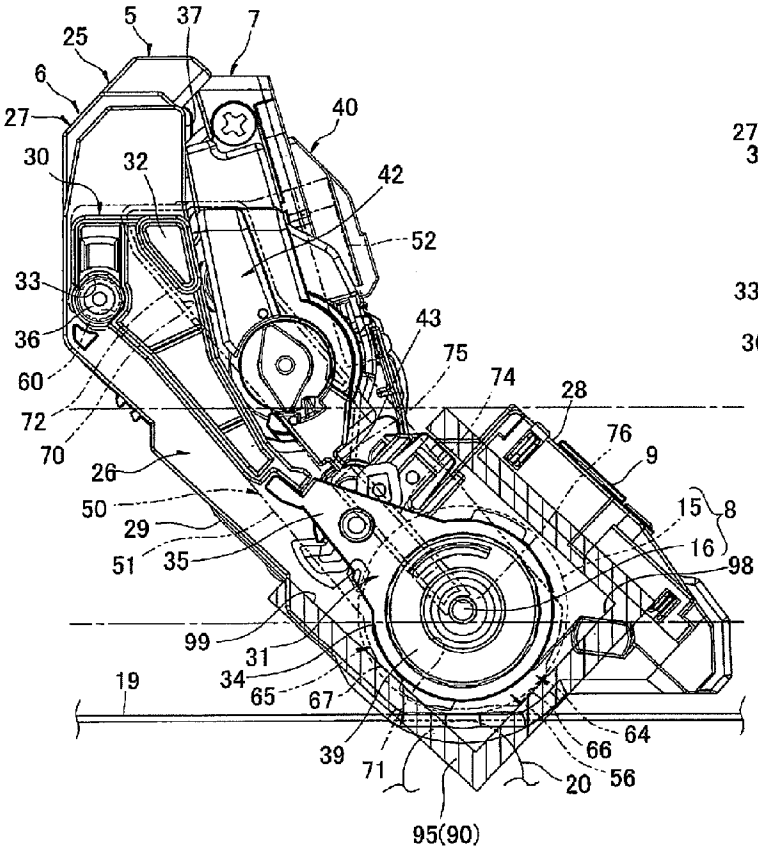

As shown in FIGS. 2 and 6A and 6B, the drum cartridge 6 has a generally rectangular frame-like shape with a closed bottom. The drum cartridge 6 is provided with a drum frame 25.

The drum frame 25 includes a pair of left and right side frame walls 26, a front frame wall 27, a top frame wall 28, and a bottom frame wall 29.

As shown in FIGS. 6A and 6B, each side frame wall 26 has a general L-shape in a side view. The front portion of the side frame wall 26 extends obliquely downward and rearward from the upper front to the lower rear. The rear portion of the side frame wall 26 extends continuously along an upward and rearward slant from the rear end of the front portion. A shaft insertion hole 33 is formed in the side frame wall 26.

The shaft insertion hole 33 has a general circular shape in a side view and penetrates the front portion of the side frame wall 26 at the front end thereof.

The side frame wall 26 includes a drum-side expanded part 30, and a retaining member 31.

The drum-side expanded part 30 is formed in the front portion of the side frame wall 26 in the approximate vertical center thereof and extends obliquely downward and rearward from the upper front to the lower rear, growing gradually narrower in its front-rear dimension toward the bottom end. The drum-side expanded part 30 protrudes outward in the left-right direction from the outer left or right surface of the respective side frame wall 26. A drum-side protruding part 32 is provided on the drum-side expanded part 30 on the right side frame wall 26.

The drum-side protruding part 32 is shaped like a triangular column that protrudes rightward from the upper rear end of the right drum-side expanded part 30.

The retaining member 31 is provided in the rear portion of the side frame wall 26. The retaining member 31 includes a cylindrical part 34, and a cover part 35. The cylindrical part 34 has a general cylindrical shape and extends outward in the left-right direction from the outer left or right surface of the respective side frame wall 26.

The cover part 35 has a generally flat plate shape and is substantially triangular in a side view. The cover part 35 is formed continuously with the upper front portion of the cylindrical part 34 and extends obliquely upward and forward therefrom. The distal end of the cover part 35 contacts the bottom end of the drum-side expanded part 30 from below.

The front frame wall 27 has a thick plate shape that is generally rectangular in a front view and elongated in the left-right direction. The front frame wall 27 bridges the front ends of the front portions of the side frame walls 26. The front frame wall 27 includes a shaft 36.

The shaft 36 has a general columnar shape and passes through the interior of the front frame wall 27 in the left-right direction. Both ends of the shaft 36 are exposed through the shaft insertion holes 33 formed in the side frame walls 26.

The top frame wall 28 has a generally flat plate shape that is substantially rectangular in a plan view and elongated in the left-right direction. The top frame wall 28 bridges the upper ends on the rear portions of both side frame walls 26.

The bottom frame wall 29 has a generally flat plate shape that is substantially rectangular in a plan view and elongated in the left-right direction. The bottom frame wall 29 bridges the lower ends of both side frame walls 26.

The front portions of both side frame walls 26, the front frame wall 27, the front end of the top frame wall 28, and the bottom frame wall 29 define a developing cartridge accommodating section 37.

A pressing mechanism (not shown) is provided on the upper front side portion of the developing cartridge accommodating section 37 (i.e., the front frame wall 27) for pressing the developing cartridge 7 in a direction obliquely downward and rearward (toward the photosensitive drum 8).

The photosensitive drum 8 is rotatably supported in the rear portion of the drum frame 25. More specifically, bearing members 39 are provided for supporting the photosensitive drum 8. The bearing members 39 are generally columnar in shape, with one bearing member 39 being disposed on each end of the photosensitive drum 8. The left bearing member 39 supports the left end of the drum body 15 constituting the photosensitive drum 8, while the right bearing member 39 supports the right end of the drum body 15. The drum shaft 16 of the photosensitive drum 8 penetrates the right bearing member 39 so as to be exposed on the right side thereof. The bearing members 39 are retained in the cylindrical parts 34 of the respective retaining members 31.

(2) Developing Cartridges

Figure 7B:
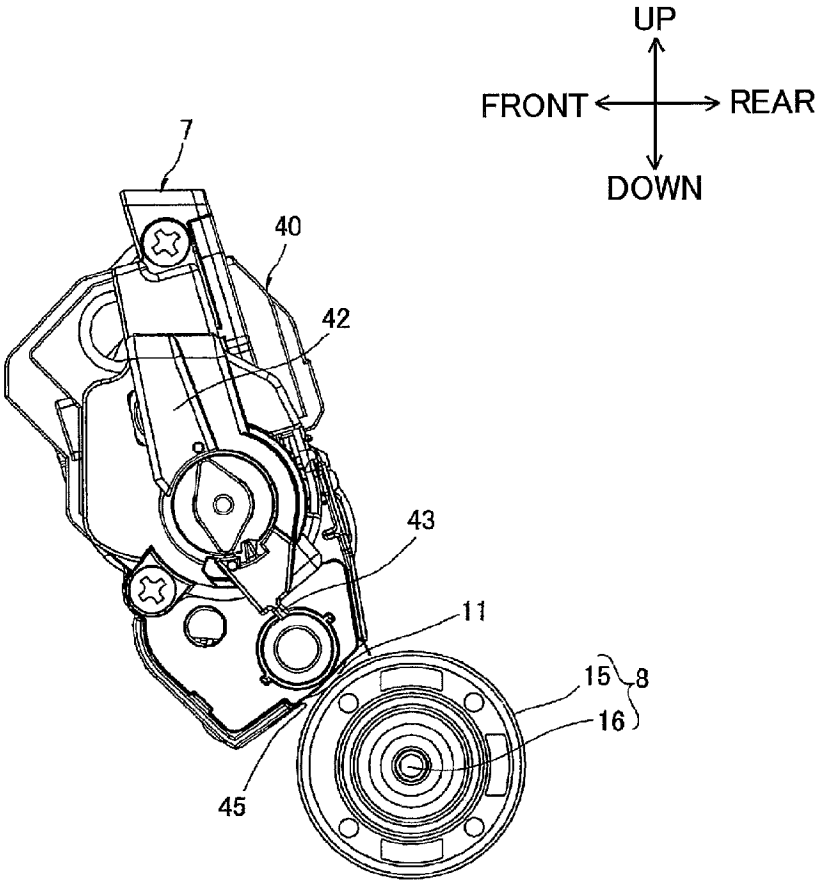
FIG. 7B illustrates how the developing roller and the photosensitive drum contact with each other when the cartridge cover has been removed from the process cartridge.
Figure 7A:
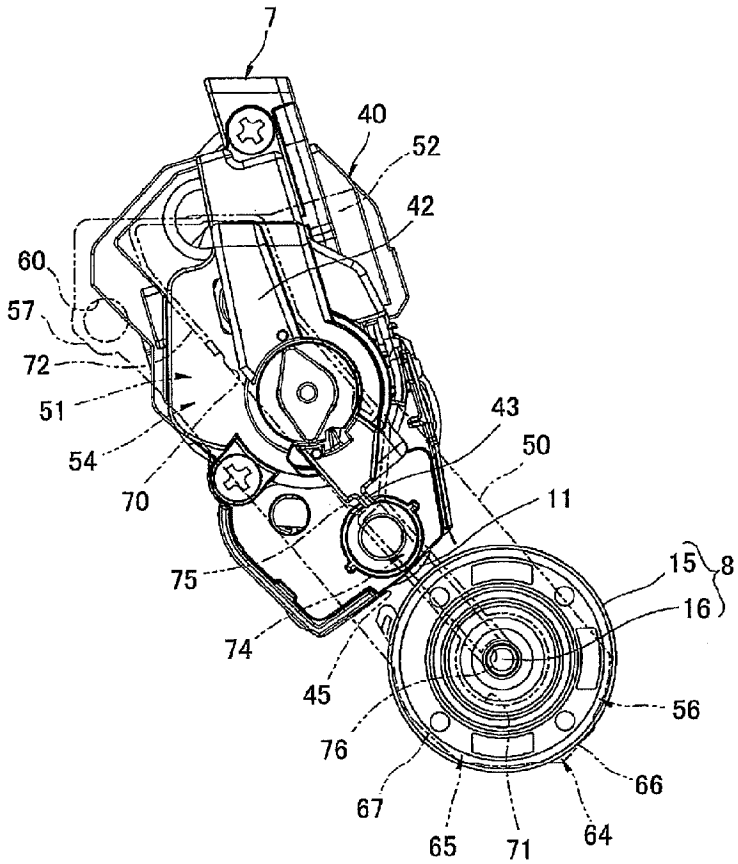
FIG. 7A illustrates how a developing roller and a photosensitive drum are separated from each other when the cartridge cover is attached to the process cartridge.

As shown in FIGS. 7A and 7B, the developing cartridge 7 is provided with a developing frame 40, and the developing roller 11.

The developing frame 40 has a box-like shape and is elongated in the left-right direction. The developing frame 40 includes an engagement part 41 (see FIG. 2) and developing-side protruding parts 42. A developing-frame opening 45 is also formed in the developing frame 40.

As shown in FIG. 2, the engagement part 41 is formed on the top of the developing frame 40 in approximately the left-right center thereof. The engagement part 41 has a generally flat plate shape and is substantially rectangular in a front view, extending upward from the developing frame 40.

Figure 3:
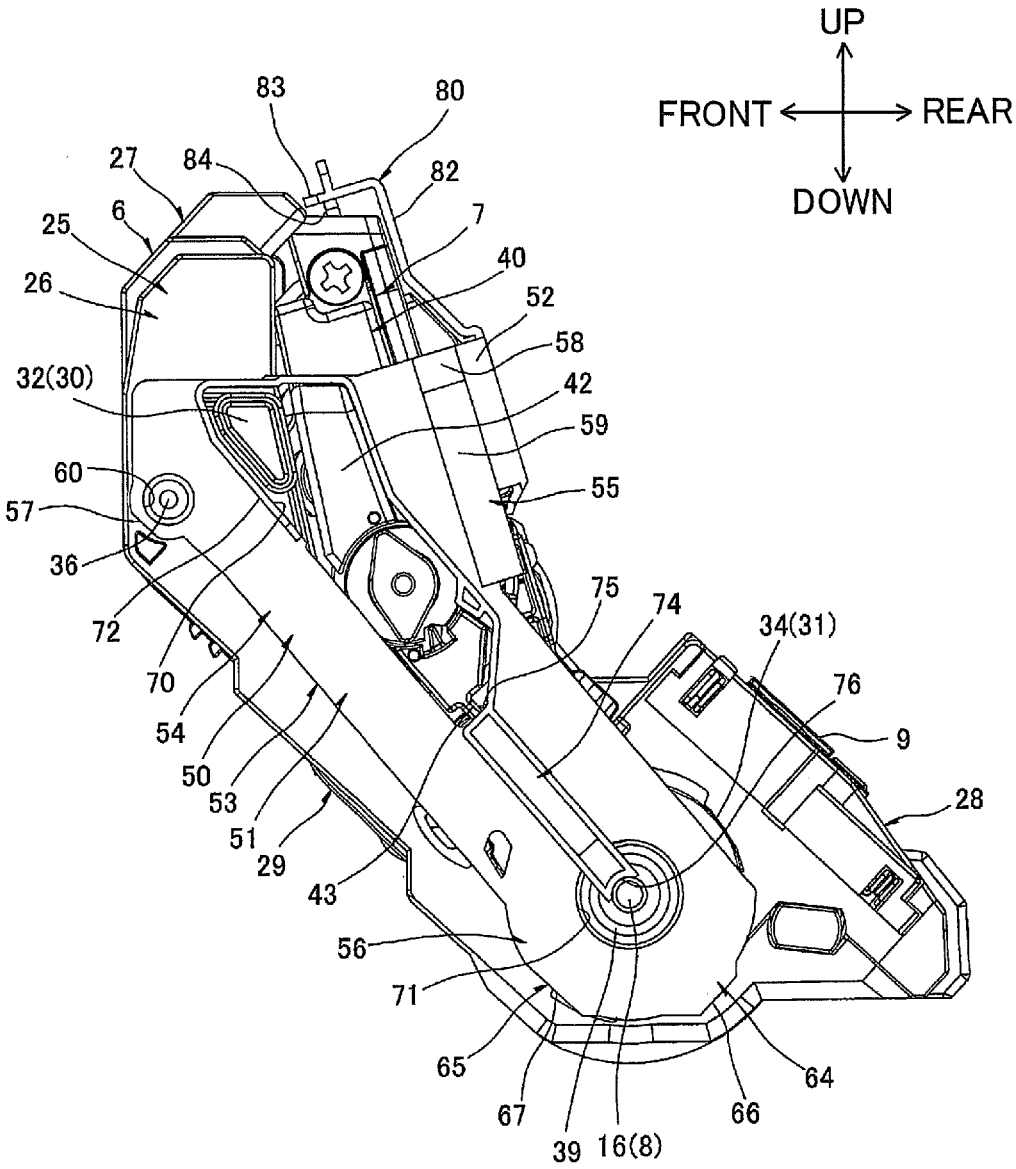
FIG. 3 is a side view of the process cartridge seen from a right side when the cartridge cover is attached to the process cartridge.

As shown in FIGS. 3 and 7A and 7B, the developing-side protruding parts 42 protrude outward in the left-right direction from the approximate front-rear center region of both left and right ends of the developing frame 40. The developing-side protruding parts 42 are shaped like a square column that is generally rectangular in a side view and elongated vertically. The developing-side protruding parts 42 are arranged such that the distance between the front surface of each developing-side protruding part 42 and the front surface of the developing frame 40 is approximately equal to the front-rear dimension of the front portion of the side frame wall 26 constituting the drum frame 25. The developing-side protruding part 42 includes a contact-receiving part 43.

The contact-receiving part 43 is formed on the lower end of the developing-side protruding part 42. The contact-receiving part 43 has a generally square columnar shape that protrudes obliquely downward and rearward.

The developing-frame opening 45 is formed in the lower rear side of the developing frame 40 to face in a direction slanting downward and rearward. The developing-frame opening 45 extends across the entire left-right dimension of the developing frame 40.

The developing roller 11 is rotatably supported in the lower end of the developing frame 40. The lower rear side surface of the developing roller 11 is exposed through the developing-frame opening 45.

The developing cartridge 7 is accommodated in the developing cartridge accommodating section 37 of the drum cartridge 6. The pressing mechanism (not shown) pushes the developing cartridge 7 diagonally downward and rearward from the upper front side thereof. This pressure places the developing roller 11, which is exposed in the developing-frame opening 45 of the developing cartridge 7, in contact with the photosensitive drum 8 supported in the drum cartridge 6. At this time, the developing-side protruding part 42 and drum-side protruding part 32 of the drum cartridge 6 are juxtaposed in the front-rear direction with their top edges vertically aligned.

3. Structure of the Cartridge Cover

As shown in FIGS. 2 and 3, when the printer 1 is shipped and transported, the process cartridges 5 are accommodated inside the main casing 2 with a cartridge cover 50 mounted on each process cartridge 5.

Figure 4A:
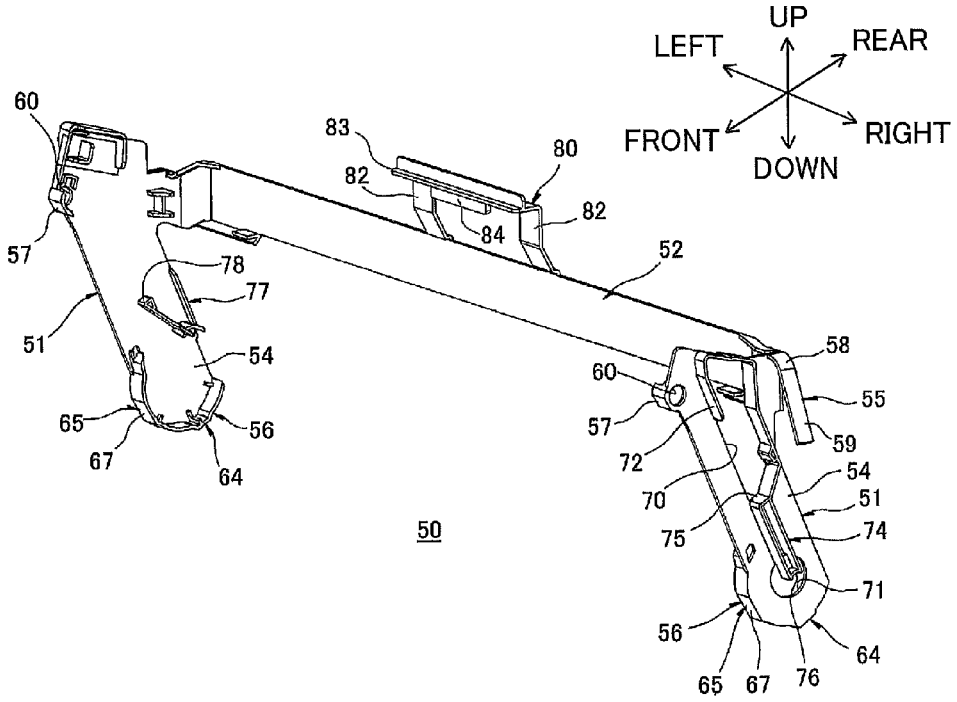
FIG. 4A is a perspective view of the cartridge cover shown in FIG. 2 and seen from an upper right side.
Figure 4B:
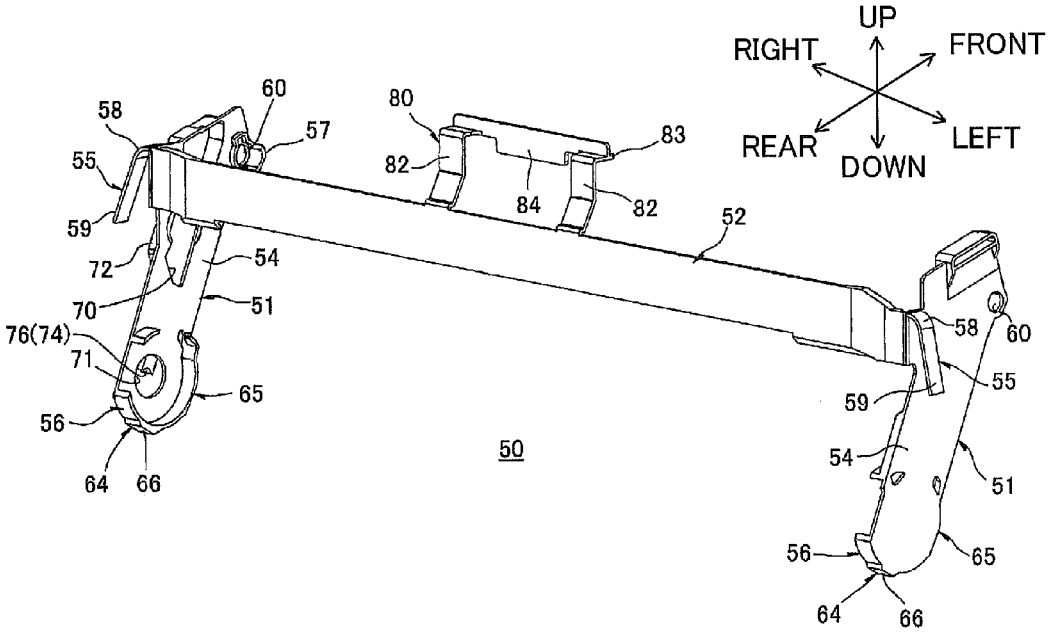
FIG. 4B is a perspective view of the cartridge cover seen from an upper left side.

As shown in FIGS. 4A and 4B, the cartridge cover 50 has a generally square U-shape in a front view. The cartridge cover 50 is formed of a synthetic polymer, such as polypropylene. The cartridge cover 50 is integrally configured of a pair of side covers 51, and a connecting part 52.

Each of the side covers 51 has a side-cover body 54, a restricting plate 55, an engaging part 56, and a first anchoring part 57.

The side-cover body 54 has a generally flat plate shape that is substantially rectangular in a side view and elongated in a direction sloping from the upper front to the lower rear. A cover-side shaft insertion hole 60 is formed in each side-cover body 54.

The cover-side shaft insertion hole 60 has a general circular shape in a side view and penetrates the side-cover body 54 in the upper front end thereof. The diameter of the cover-side shaft insertion hole 60 is approximately equal to (slightly larger than) the diameter of the shaft 36.

The restricting plate 55 includes a curved part 58, and a flat part 59.

The curved parts 58 have a generally flat plate shape and extend outward in respective left and right directions from the upper rear edges of the side-cover bodies 54 while curving downward toward the left-right outer sides.

The flat parts 59 have a generally flat plate shape and are formed continuously with the bottom ends of the curved parts 58. The flat parts 59 extend obliquely downward and outward in left and right directions, respectively.

The restricting plates 55 can move between a first position (indicated by broken lines in FIG. 2) in which the flat parts 59 follow the outer left and right surfaces of the side-cover bodies 54, and a second position (indicated by solid lines in FIG. 2) in which the flat parts 59 extend obliquely downward and outward in left and right directions (in directions away from the outer left and right surfaces of the side-cover bodies 54). The elastic force of the curved parts 58 constantly urges the restricting plates 55 into the second position. The restricting plates 55 move into the first position when the restricting plates 55 are pressed inward in left and right directions on the bottom ends of the flat parts 59.

The engaging parts 56 protrude inward in left and right directions from the bottom ends of the respective side-cover bodies 54. The engaging parts 56 have a generally flat plate shape that is arc-shaped in a side view, with the inner surfaces conforming to the outer peripheries of the cylindrical parts 34 constituting the retaining members 31. Each engaging part 56 includes a first contact part 64, and a second contact part 65.

The first contact part 64 constitutes the lower rear portion of the engaging part 56 and expands slightly downward and rearward. The lower rear surface of the first contact part 64 is generally rectangular in a bottom view and slopes downward toward the front. This lower rear surface will be called a first contact surface 66.

The second contact part 65 constitutes the lower front portion of the engaging part 56 and expands slightly downward and forward. The lower front surface of the second contact part 65 is generally rectangular in a bottom view and slopes downward toward the rear. This lower front surface will be called a second contact surface 67.

The first anchoring parts 57 are disposed on the upper front ends of the side covers 51. The first anchoring parts 57 protrude inward with respect to the left-right direction from the front and bottom peripheral edges of the cover-side shaft insertion holes 60. The first anchoring parts 57 have a generally flat plate shape that is arc-shaped in a side view with their inner surfaces conforming to the outer periphery of the shaft 36 in the drum cartridge 6.

The side cover 51 on the right side further includes a protruding-part exposing hole 70, a protruding-part protecting part 72, a photosensitive-drum-shaft exposing hole 71, and a rod-shaped part 74.

The protruding-part exposing hole 70 is formed in the upper portion of the right side-cover body 54, penetrating the upper portion in approximately the front-rear center thereof. The protruding-part exposing hole 70 is generally rectangular in a side view and extends in a direction downward and rearward. In a side view, the protruding-part exposing hole 70 substantially conforms to the outer shape of the developing-side protruding part 42 and drum-side protruding part 32 of the process cartridge 5.

The protruding-part protecting part 72 has a generally square cylindrical shape and protrudes rightward from the peripheral edge of the protruding-part exposing hole 70 so as to surround the protruding-part exposing hole 70. The protruding height (left-right dimension) of the protruding-part protecting part 72 is approximately equal to the protruding heights (left-right dimensions) of the drum-side protruding part 32 and developing-side protruding part 42.

The photosensitive-drum-shaft exposing hole 71 is formed in the lower portion of the side-cover body 54, penetrating the side-cover body 54 in approximately the front-rear center region. The photosensitive-drum-shaft exposing hole 71 is generally circular in a side view and has a diameter that is larger than the diameter of the drum shaft 16 but smaller than the diameter of the cylindrical part 34.

The rod-shaped part 74 is generally rod-shaped and extends from the bottom edge of the protruding-part exposing hole 70 to the center region of the photosensitive-drum-shaft exposing hole 71. The top surface of the rod-shaped part 74 constitutes a first contact part 75, and the bottom surface constitutes a second contact part 76.

The left side cover 51 is also provided with a support plate 77. The support plate 77 is formed on the rear edge of the side-cover body 54 in approximately the vertical center region thereof. The support plate 77 protrudes rightward from the right surface of the side-cover body 54 and has a generally flat plate shape that forms a V-shape in a side view, with the opening of the "V" on the top. The upper end on the front portion of the V-shaped support plate 77 constitutes a third contact part 78. The third contact part 78 is aligned with the first contact part 75 in the left-right direction.

The connecting part 52 has a flat plate shape that is generally rectangular in a front view. The connecting part 52 integrally bridges the rear edges of the side covers 51 at the upper portions thereof. The connecting part 52 includes a second anchoring part 80.

The second anchoring part 80 is configured of a pair of bent plates 82, a base 83, and an anchoring pawl 84.

The bent plates 82 are disposed on the upper edge of the connecting part 52 in the general left-right center region thereof and are spaced apart in the left-right direction. The bent plates 82 slope upward and forward from the upper edge of the connecting part 52, then bend and extend upward.

The base 83 integrally bridges the top ends of the bent plates 82. The base 83 has a flat plate shape that is generally L-shaped in a side view.

The anchoring pawl 84 extends downward from the bottom surface of the base 83. The anchoring pawl 84 has a flat plate shape that is generally rectangular in a plan view.

The cartridge cover 50 is mounted on the process cartridge 5. More specifically, as illustrated in FIG. 2, the engaging parts 56 are fitted around the cylindrical parts 34 of the drum frame 25 so as to contact the bottom portions of the cylindrical parts 34. The first anchoring parts 57 support the left and right ends of the shaft 36 in the drum frame 25 from the lower front sides thereof, as illustrated in FIG. 6A.

As shown in FIG. 2, the second anchoring part 80 engages with the engagement part 41. More specifically, the second anchoring part 80 is engaged with the engagement part 41, such that the bent plates 82 of the second anchoring part 80 follow the rear surface of the engagement part 41 and the anchoring pawl 84 hooks over the engagement part 41.

On the right side of the process cartridge 5, the developing-side protruding part 42 and drum-side protruding part 32 are fitted into the protruding-part exposing hole 70 from the left side and are exposed on the right side of the side cover 51 through the protruding-part exposing hole 70. Similarly, the right end of the drum shaft 16 is fitted into the photosensitive-drum-shaft exposing hole 71 and exposed on the outside thereof. At this time, the rod-shaped part 74 is positioned between the contact-receiving part 43 of the developing-side protruding part 42 and drum shaft 16 of the photosensitive drum 8 with the first contact part 75 contacting the contact-receiving part 43 and the second contact part 76 contacting the drum shaft 16. On the left side of the process cartridge 5, the third contact part 78 contacts the contact-receiving part 43 of the developing-side protruding part 42. The contacts attained at the first through third contact parts 75, 76, and 78 hold the developing cartridge 7 in a position diagonally above and forward of the drum cartridge 6 against the urging force of the pressing mechanism (not shown). As a result, the developing roller 11 provided in the developing cartridge 7 is separated slightly from the photosensitive drum 8 provided in the drum cartridge 6 in a direction obliquely upward and forward of the photosensitive drum 8.

4. Structure of the Main Casing

Figure 5A:
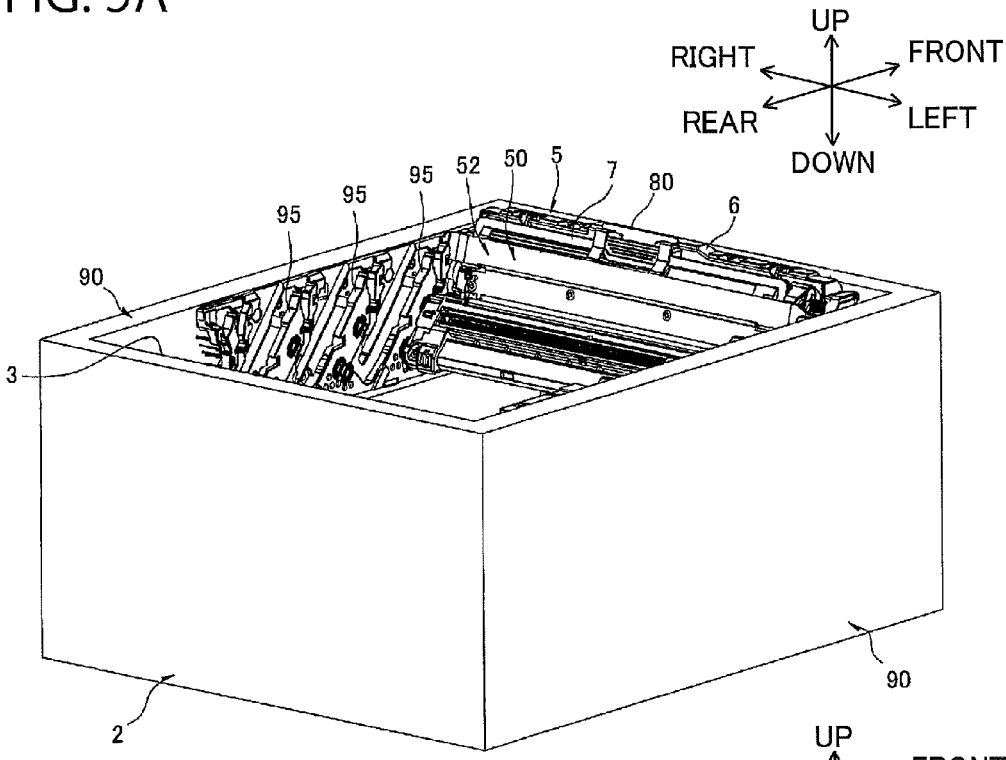

As shown in FIG. 5A, the main casing 2 has a box-like shape with an open top. The main casing 2 includes a pair of side walls 90.

The side walls 90 are arranged parallel to each other and separated in the left-right direction. Each side wall 90 has a thick plate shape that is generally rectangular in a side view, extending in vertical and front-rear directions. Cartridge guide grooves 95 are formed in each side wall 90.

The cartridge guide grooves 95 are formed on the inner left or right surface of the respective side wall 90 and are arranged parallel to one another and spaced at equal intervals in the front-rear direction. The cartridge guide grooves 95 are formed by ridges that protrude inward in the left and right directions from the left and right inner surfaces of the respective side walls 90. The cartridge guide grooves 95 slope diagonally downward and rearward from the upper portion of each side wall 90 and are generally U-shaped in a plan view and open on the top (see FIGS. 6A and 6B). The front-rear dimension of the cartridge guide groove 95 is larger than the diameter of the cylindrical part 34.

As shown in FIGS. 6A and 6B, the inner surface on the lower rear side of the cartridge guide groove 95 constitutes a first contact-receiving surface 98, while the inner surface on the lower front side of the cartridge guide groove 95 constitutes a second contact-receiving surface 99.

5. Mounting and Removing the Process Cartridges Relative to the Main Casing (1) Mounted State of a Process Cartridge in the Main Casing When the Cartridge Cover is Attached When the process cartridge 5 is mounted in the main casing 2 with the cartridge cover 50 attached thereto, as illustrated in FIGS. 5A and 6A, the side covers 51 of the cartridge cover 50 are positioned along the cartridge guide grooves 95 in the main casing 2. In this state, the first contact surface 66 of the first contact part 64 provided on each side cover 51 contacts the first contact-receiving surface 98 of the corresponding cartridge guide groove 95, and the second contact surface 67 of the second contact part 65 provided on each side cover 51 contacts the second contact-receiving surface 99 of the corresponding cartridge guide groove 95, as illustrated in FIG. 6A. Thus, when the cartridge cover 50 is attached to the process cartridge 5, the process cartridge 5 is positioned higher than when the process cartridge 5 is mounted in the main casing 2 with the cartridge cover 50 not attached (see FIG. 6B) by an amount equivalent to the thicknesses of the first contact part 64 and second contact part 65. Accordingly, the drum body 15 of the photosensitive drum 8 is separated from the conveying belt 19.

In addition, the flat part 59 of each restricting plate 55 contacts the inner left-right surface of the corresponding cartridge guide groove 95 provided in the main casing 2 and is flush with this surface (indicated by the broken line in FIG. 2).

Hence, the restricting plates 55 are in their first position in which the flat parts 59 follow the outer left and right surfaces of the corresponding side-cover bodies 54.

Figure 5B:
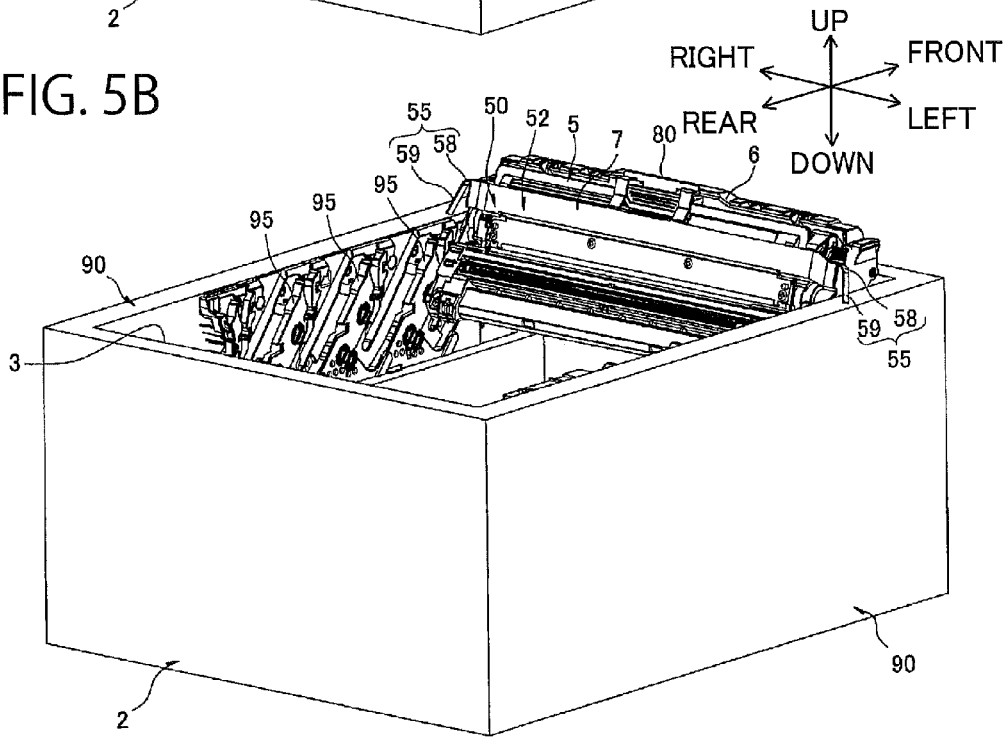

(2) Removing a Process Cartridge from the Main Casing When the Cartridge Cover is Attached To remove a process cartridge 5 from the main casing 2 when the cartridge cover 50 is attached, the operator grips the upper portion of the process cartridge 5 and pulls the process cartridge 5 diagonally upward and forward from the main casing 2, as illustrated in FIG. 5B. As the process cartridge 5 is lifted upward, the side covers 51 of the cartridge cover 50 move diagonally upward and forward along the cartridge guide grooves 95 provided in the main casing 2 until the process cartridge 5 is pulled free from the main casing 2. This completes the operation for removing a process cartridge 5 from the main casing 2 when the cartridge cover 50 is attached.

Further, when the restricting plates 55 of the cartridge cover 50 no longer contact the left and right surfaces of the corresponding cartridge guide grooves 95, the elastic force of the curved parts 58 restore the restricting plates 55 to their second position (indicated by the solid lines in FIG. 2) in which the flat parts 59 extend outward in left and right directions while sloping downward.

(3) Mounting a Process Cartridge in the Main Casing

To mount a process cartridge 5 in the main casing 2 in order to use the printer 1, first the user must remove the cartridge cover 50. The cartridge cover 50 is removed from the process cartridge 5 by pulling the side covers 51 outward in respective left and right directions so that the side covers 51 bend about the connecting regions between the side covers 51 and connecting part 52.

This action removes the engaging parts 56 from around the cylindrical parts 34 and separates the first anchoring parts 57 from the shaft 36 so that the first anchoring parts 57 no longer support the shaft 36. In addition, the protruding-part exposing hole 70 is pulled outward so that the developing-side protruding part 42 and drum-side protruding part 32 are no longer fitted therein. Further, by moving the rod-shaped part 74 outward (rightward), the first contact part 75 separates from the contact-receiving part 43 and the second contact part 76 separates from the drum shaft 16. Consequently, as shown in FIG. 7B, the urging force of the pressing mechanism (not shown) presses the developing cartridge 7 toward the photosensitive drum 8, placing the developing roller 11 in contact with the photosensitive drum 8.

Next, the process cartridge 5 is mounted in the main casing 2. To mount the process cartridge 5 in the main casing 2, the operator grips the upper portion of the process cartridge 5 and places the process cartridge 5 in a position above the main casing 2 and aligned with the corresponding cartridge guide groove 95 in the front-rear direction, as shown in FIG. 5B. Next, the operator inserts the process cartridge 5 downward into the main casing 2 so that the cylindrical parts 34 of the drum cartridge 6 follow the corresponding cartridge guide grooves 95.

Through this operation, the bottom portion of the drum body 15 constituting the photosensitive drum 8 contacts the conveying belt 19 before the lower rear portion of the cylindrical parts 34 in the process cartridge 5 contact the first contact-receiving surfaces 98. The operation for mounting the process cartridge 5 in the main casing 2 is completed at this time.

Here, it is conceivable that the user may forget to remove the cartridge cover 50 from the process cartridge 5 and may attempt to remount the process cartridge 5 in the main casing 2 with the cartridge cover 50 still attached. However, since the restricting plates 55 of the cartridge cover 50 are in the second position, the bottom ends of the restricting plates 55 (the bottom ends of the flat parts 59) will contact the top surface of the side walls 90 constituting the main casing 2, as shown in FIG. 5B, restricting the user from mounting the process cartridge 5.

Accordingly, this configuration prevents the user from mounting a process cartridge 5 in the main casing 2 while the cartridge cover 50 is still attached, forcing the user to remove the cartridge cover 50 from the process cartridge 5 in order to mount the process cartridge 5.

6. Operational Advantages (1) When the printer 1 according to the embodiment is shipped or transported, the process cartridges 5 are included inside the main casing 2, with a cartridge cover 50 mounted on each process cartridge 5, as illustrated in FIG. 5A. In order to use the printer 1, the user removes the process cartridges 5 from the main casing 2 and remounts the process cartridges 5 after removing the cartridge covers 50.

If the user forgets to remove the cartridge cover 50 from a process cartridge 5 and attempts to remount the process cartridge 5 in the main casing 2, the restricting plates 55 on the cartridge cover 50 restrict the process cartridge 5 from being mounted. Thus, the configuration of the cartridge cover 50 prevents the process cartridge 5 from being remounted to its mounted position in the main casing 2 while the cartridge cover 50 is still attached.

Further, since the process cartridge 5 is restricted prior to reaching the mounted position inside the main casing 2, the user is made aware that the cartridge cover 50 is still attached to the process cartridge 5 and can remove the cartridge cover 50 at this point. Accordingly, the user can easily and quickly make use of the printer 1, even after forgetting to remove the cartridge cover 50 from a process cartridge 5 when remounting the process cartridge 5 in the main casing 2.

(2) Further, when the printer 1 is shipped and transported, one cartridge cover 50 is attached to each process cartridge 5 and the process cartridges 5 are mounted in the main casing 2, as shown in FIG. 5A, with the restricting plates 55 disposed in the first position (indicated by the broken lines in FIG. 2). When the process cartridges 5 are subsequently removed from the main casing 2, the restricting plates 55 of the cartridge cover 50 shift to the second position (indicated by the solid lines in FIG. 2).

In order to use the printer 1, the user removes the cartridge covers 50 from the process cartridges 5 and remounts the process cartridges 5 in the main casing 2. If the user forgets to remove the cartridge cover 50 from a process cartridge 5 and attempts to remount the process cartridge 5 in the main casing 2, the lower ends of the restricting plates 55, now in the second position, collide with the top surfaces on the side walls 90 constituting the main casing 2, thereby restricting the process cartridge 5 from being mounted in the main casing 2.

Consequently, once the process cartridge 5 has been removed from the main casing 2, the process cartridge 5 cannot be mounted in the main casing 2 with the cartridge cover 50 still attached, thereby reminding the user that the user has forgotten to remove the cartridge cover 50. Accordingly, this configuration can reliably prevent a process cartridge 5 from being remounted into the mounted position inside the main casing 2 while the cartridge cover 50 is attached to the process cartridge 5.

(3) Since the restricting plates 55 are integrally formed on the cartridge cover 50, as shown in FIGS. 4A and 4B, the cartridge cover 50 can be formed with fewer parts and a simpler structure.

(4) By elastically deforming the cartridge cover 50, as illustrated in FIG. 5A, the process cartridge 5 can be inserted inside the main casing 2 when shipping the printer 1. When subsequently setting up the printer 1 for use, the process cartridges 5 are first removed from the main casing 2 and remounted after removing the cartridge covers 50. If the user forgets to remove the cartridge cover 50 when remounting a process cartridge 5 in the main casing 2, the cartridge cover 50 restricts such mounting because the cartridge cover 50 has been restored to its natural shape.

Since the cartridge cover 50 restricts the process cartridge 5 before the process cartridge 5 reaches its mounted position inside the main casing 2, the user will notice that the cartridge cover 50 is still attached to the process cartridge 5 and can remove the cartridge cover 50 before continuing to mount the process cartridge 5.

(5) When the cartridge cover 50 is mounted on the process cartridge 5, the developing roller 11 is separated from the photosensitive drum 8, as illustrated in FIG. 7A. This arrangement prevents the developing roller 11 and photosensitive drum 8 from rubbing or abrading each other due to vibrations or impacts occurring during shipping and transport. Thus, the cartridge cover 50 can maintain the printer 1 in good condition.

(6) Further, when a process cartridge 5 with an attached cartridge cover 50 is mounted in the main casing 2, as illustrated in FIG. 6A, the photosensitive drum 8 is separated from the conveying belt 19. Accordingly, the cartridge cover 50 can prevent the photosensitive drum 8 and conveying belt 19 from rubbing or abrading each other due to vibrations or impacts occurring during shipping and transport. Thus, the cartridge cover 50 can maintain the printer 1 in good condition.

7. Second Embodiment

Next, a printer 1 according to a second embodiment will be described with reference to FIGS. 8A and 8B, wherein like parts and components as those in the first embodiment are designated with the same reference numerals to avoid duplicating description.

(1) Structure According to the Second Embodiment

In the first embodiment described above, the restricting plates 55 are provided on the cartridge cover 50. The restricting plates 55 can move between a first position indicated by the broken lines in FIG. 2, and a second position indicated by the solid lines in FIG. 2. In the first position, the lower ends of the flat parts 59 are pressed and held inward in respective left and right directions by the inner left and right surfaces of the cartridge guide grooves 95 constituting the main casing 2, and thus the flat parts 59 extend along the left and right outer surfaces of the side-cover bodies 54. In the second position, the flat parts 59 extend outward in left and right directions along a downward slope. When a process cartridge 5 is removed from the main casing 2 with the cartridge cover 50 still attached, the restricting plates 55 are no longer held in by the inner left and right surfaces of the cartridge guide grooves 95 and move outward to the second position. The restricting plates 55 are normally maintained in the second position. So, if the user attempts to remount the process cartridge 5 in the main casing 2 without removing the cartridge cover 50, the restricting plates 55 in the second position contact the top surfaces of the side walls 90 constituting the main casing 2 and restrict this mounting (see FIG. 5B).

In the second embodiment, an urging mechanism 105 is provided on each side wall 90 of the main casing 2, and a protruding wall 120 is provided on each side cover 51 of the cartridge cover 50.

Each urging mechanism 105 includes a first plate 107, a second plate 108, a moving member 109, and a spring member 110.

Figure 8A:
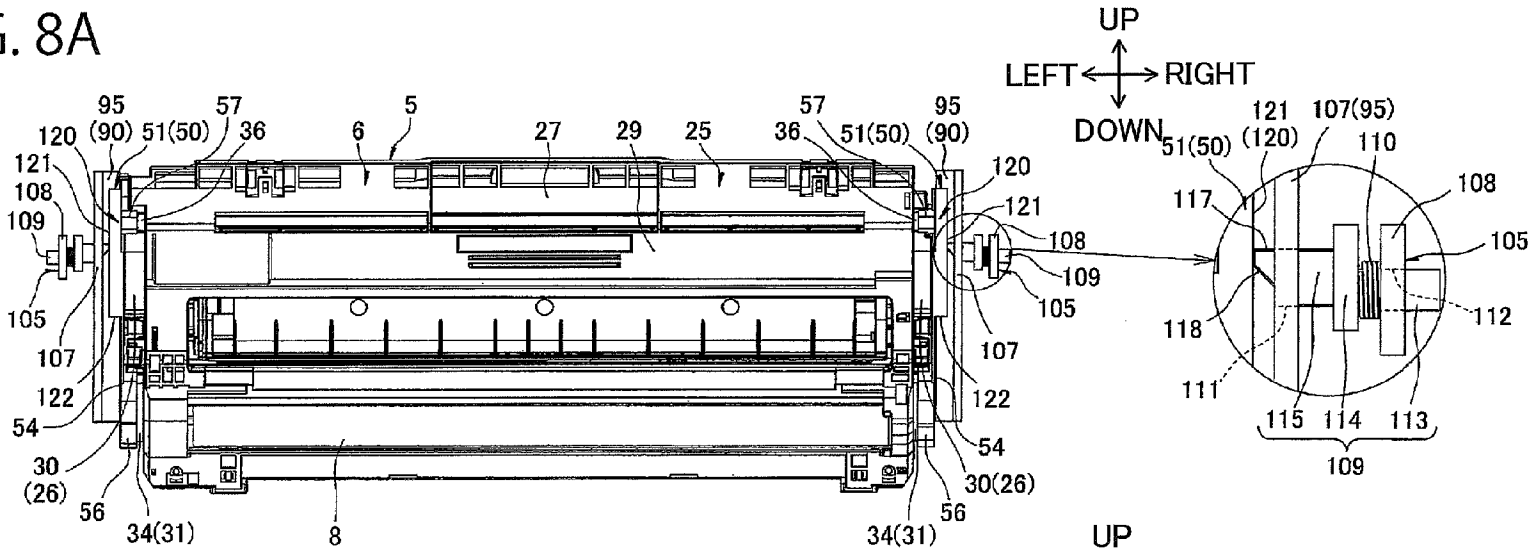
Figure 8B:
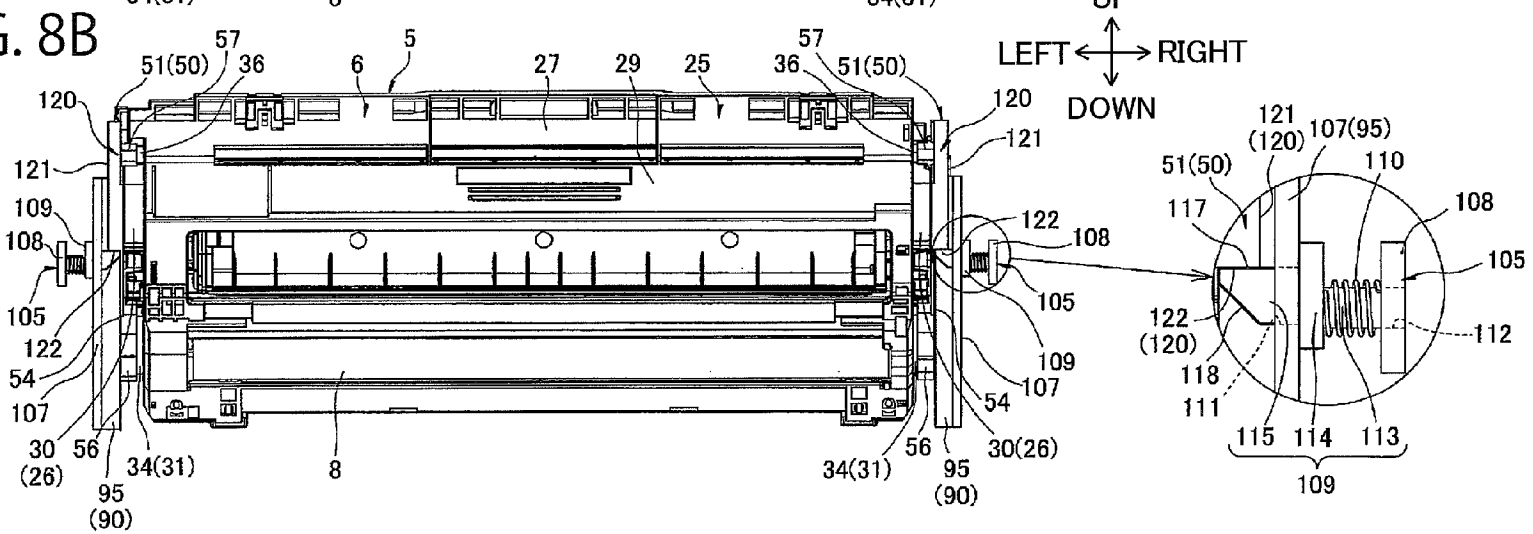

As shown in FIG. 8B, the first plates 107 of left and right urging mechanisms 105 constitute the left and right outer walls of the cartridge guide grooves 95. The first plates 107 have a generally flat plate shape. A first-plate through-hole 111 is formed in the front rear center region of each first plate 107. The first-plate through-holes 111 are generally rectangular in a side view.

The second plates 108 are positioned outside the corresponding first plates 107 in the left-right direction. The second plates 108 confront the corresponding first plates 107 in the left-right direction but are separated therefrom. The second plates 108 have a generally flat plate shape. A second-plate through-hole 112 is formed in the approximate front-rear center region of each second plate 108. The second-plate through-holes 112 have a general circular shape in a side view.

The moving member 109 includes a first sliding part 113, a restricting part 114, and a second sliding part 115.

The first sliding part 113 has a general columnar shape that is elongated in the left-right direction. The first sliding part 113 is inserted through the corresponding second-plate through-hole 112 of the second plate 108 from the inner side with respect to the left-right direction.

Each restricting part 114 is formed continuously with the left-right inner end of the corresponding first sliding part 113. The restricting parts 114 have a general flat plate shape with larger dimensions than the first-plate through-holes 111 formed in the first plates 107 and the second-plate through-holes 112 formed in the second plates 108.

The second sliding parts 115 have a generally square columnar shape. The second sliding parts 115 are formed continuously with the left-right inner surface of the corresponding restricting parts 114 and protrude inward in respective left and right directions from the approximate center region of the inner surface. The second sliding parts 115 are inserted through the corresponding first-plate through-holes 111 of the first plates 107 from the outer side with respect to the left-right direction. The top surface of the second sliding part 115 constitutes a sliding-part orthogonal surface 117 that extends in the left-right direction. The bottom surface of the second sliding part 115 constitutes a sliding-part sloped surface 118 that slopes upward in the inner left or right direction.

The moving members 109 are supported on the side walls 90 while being capable of moving in left and right directions. Specifically, each moving member 109 is supported by inserting the second sliding part 115 through the first-plate through-hole 111 of the first plate 107 and by inserting the first sliding part 113 through the second-plate through-hole 112 in the second plate 108.

The spring member 110 has a helical shape. The spring member 110 is placed around the peripheral surface of the first sliding part 113 so as to be oriented in the left-right direction. The outer end of the spring member 110 in the left-right direction contacts the inside surface of the second plate 108, and the inner end contacts the outer surface of the restricting part 114. Thus, the spring member 110 constantly urges the moving member 109 inward with respect to the left-right direction so that the inner left or right surface of the restricting part 114 contacts the outer surface of the first plate 107.

The urging mechanism 105 is in a second position shown in the enlarged view of FIG. 8B when the moving member 109 is positioned inward in the left-right direction by the urging force of the spring member 110, with the inner left or right surface of the restricting part 114 contacting the outer left or right surface of the first plate 107. The urging mechanism 105 is in a first position shown in the enlarged view of FIG. 8A when the moving member 109 is positioned outward in the left-right direction against the urging force of the spring member 110.

The protruding walls 120 protrude outward in the left-right direction from the outer surfaces of corresponding side-cover bodies 54 on the upper portions of the side covers 51 and are elongated vertically. Each protruding wall 120 has an outer left or right surface constituting a side protrusion surface 121, and a bottom surface constituting a bottom protrusion surface 122.

(2) Mounted State of a Process Cartridge in the Main Casing in the Second Embodiment When the Cartridge Cover is Attached FIG. 8A shows the state of the process cartridge 5 mounted in the main casing 2 when the cartridge cover 50 is attached to the process cartridge 5. In this state, the side protrusion surfaces 121 of the corresponding protruding walls 120 contact the second sliding parts 115 of the urging mechanisms 105 from the inner side with respect to the left-right direction. Hence, the urging mechanisms 105 are in the first position when the process cartridge 5 is mounted in the main casing 2 with the cartridge cover 50 attached.

(3) Removing a Process Cartridge from the Main Casing in the Second Embodiment When the Cartridge Cover is Attached To remove the process cartridge 5 from the main casing 2 when the cartridge cover 50 is attached, the user grips the top portion of the process cartridge 5 and pulls the process cartridge 5 diagonally upward and forward from the main casing 2. During this operation, the urging mechanisms 105 remain in the first position while the side covers 51 of the cartridge cover 50 move diagonally upward and forward along the cartridge guide grooves 95.

As the user continues to pull the process cartridge 5 upward and forward, the second sliding parts 115 slide past and separate from the side protrusion surfaces 121. Consequently, the urging force of the spring members 110 moves the moving members 109 inward in the left-right direction until the urging mechanisms 105 are in the second position. This completes the operation to remove the process cartridge 5 from the main casing 2 when the cartridge cover 50 is attached to the process cartridge 5.

(4) Mounting a Process Cartridge in the Main Casing in the Second Embodiment

To mount a process cartridge 5 in the main casing 2, first the user removes the cartridge cover 50 from the process cartridge 5 according to the same procedure described in the first embodiment. Next, the user mounts the process cartridge 5 in the main casing 2 according to the same procedure described in the first embodiment. At this time, the urging mechanisms 105 remain in the second position and do not contact the process cartridge 5 when the process cartridge 5 is mounted in the main casing 2.

However, if the user forgets to remove the cartridge cover 50 from the process cartridge 5 and attempts to remount the process cartridge 5 in the main casing 2, the bottom protrusion surfaces 122 of the protruding walls 120 will contact the sliding-part orthogonal surfaces 117 of the second sliding parts 115 since the urging mechanisms 105 are still in the second position, as shown in FIG. 8B. Accordingly, this contact restricts the process cartridge 5 from being mounted in the main casing 2. In this way, the structure of the second embodiment can prevent a process cartridge 5 from being mounted in the main casing 2 while the cartridge cover 50 is still attached, ensuring that the user removes the cartridge cover 50 from the process cartridge 5.

(5) Operational Advantages of the Second Embodiment

When the printer 1 according to the second embodiment is shipped and transported, as shown in FIG. 8A, the process cartridges 5 are included inside the main casing 2 with the cartridge covers 50 attached to the process cartridges 5 and the urging mechanisms 105 disposed in the first position. Once the process cartridges 5 with the attached cartridge covers 50 are removed from the main casing 2, the urging mechanisms 105 move into their second position.

Accordingly, if the user forgets to remove the cartridge cover 50 from a process cartridge 5 and attempts to remount the process cartridge 5 in the main casing 2, the urging mechanisms 105 in the second position interfere with the protruding walls 120 of the cartridge cover 50, restricting the process cartridge 5 from being mounted in the main casing 2. Consequently, once a process cartridge 5 has been removed from the main casing 2, the process cartridge 5 cannot be remounted in the main casing 2 with the cartridge covers 50 attached. This structure reminds the user to remove the cartridge cover 50.

Therefore, the structure described in the second embodiment can reliably prevent the process cartridge 5 from being remounted to its mounted position in the main casing 2 while the cartridge cover 50 is still attached.

The printer 1 according to the second embodiment achieves the same operational advantages described in the first embodiment.

8. Third Embodiment

Next, a printer 1 according to a third embodiment will be described with reference to FIGS. 9A-9C, wherein like parts and components as those in the first and second embodiments are designated with the same reference numerals to avoid duplicating description.

(1) Structure of the Third Embodiment

In the second embodiment described above, a protruding wall 120 is provided on each side cover 51 of the cartridge cover 50. Further, the urging mechanisms 105 are disposed in the first position while the process cartridge 5 is mounted in the main casing 2 with the cartridge cover 50 attached, and move to the second position when the process cartridge 5 is removed from the main casing 2. With this configuration, if the user forgets to remove the cartridge cover 50 from the process cartridge 5 before remounting the process cartridge 5 in the main casing 2, the bottom protrusion surfaces 122 of the protruding walls 120 contact the sliding-part orthogonal surfaces 117 on the second sliding parts 115 of the urging mechanisms 105 in the second position, restricting the process cartridge 5 from being mounted (see FIG. 8(*b*)).

However, in the third embodiment, the protruding walls 120 are not provided on the side covers 51 of the cartridge cover 50, but a serrated part 125 is provided on each side cover 51.

The serrated part 125 is disposed on the side cover 51 below the first anchoring part 57. The serrated part 125 is configured of six protruding parts 126 formed continuously along the vertical direction.

The protruding parts 126 protrude outward from the outer surface of the side-cover body 54 with respect to the left-right direction. The protruding parts 126 are generally triangular in a front view with a vertical dimension that grows narrower toward the outer left or right side. The top surface of each protruding part 126 constitutes a serrated-part sloped surface 127 that slopes downward toward the outer left or right side, while the bottom surface constitutes a serrated-part orthogonal surface 128 that extends along the left-right direction.

Figure 9A:
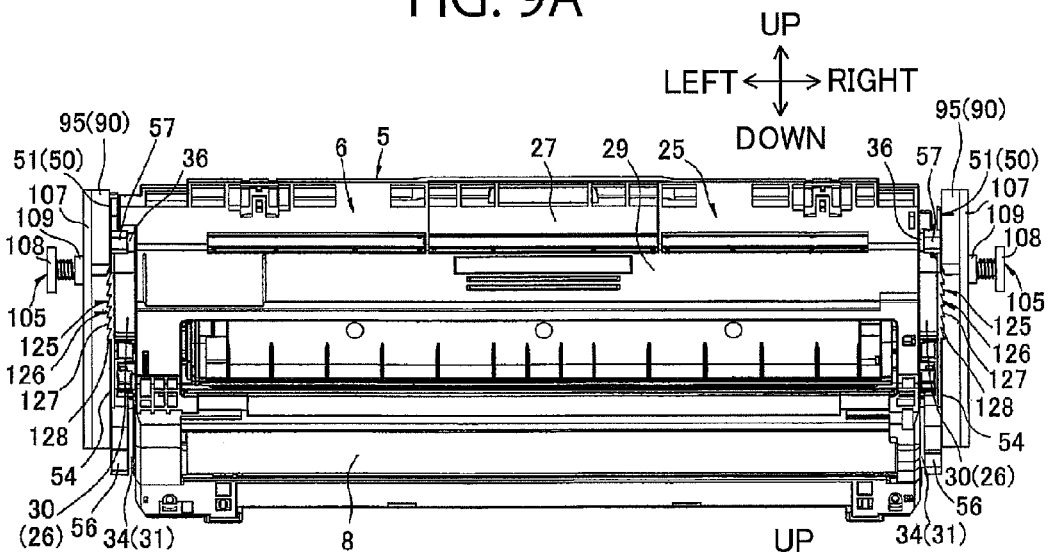
Figure 9B:
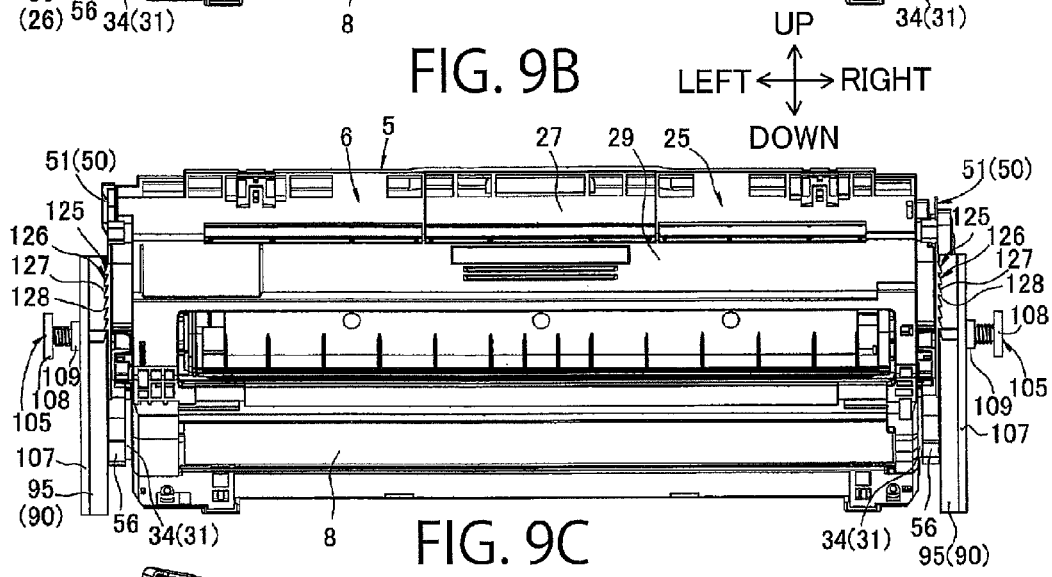
Figure 9C:
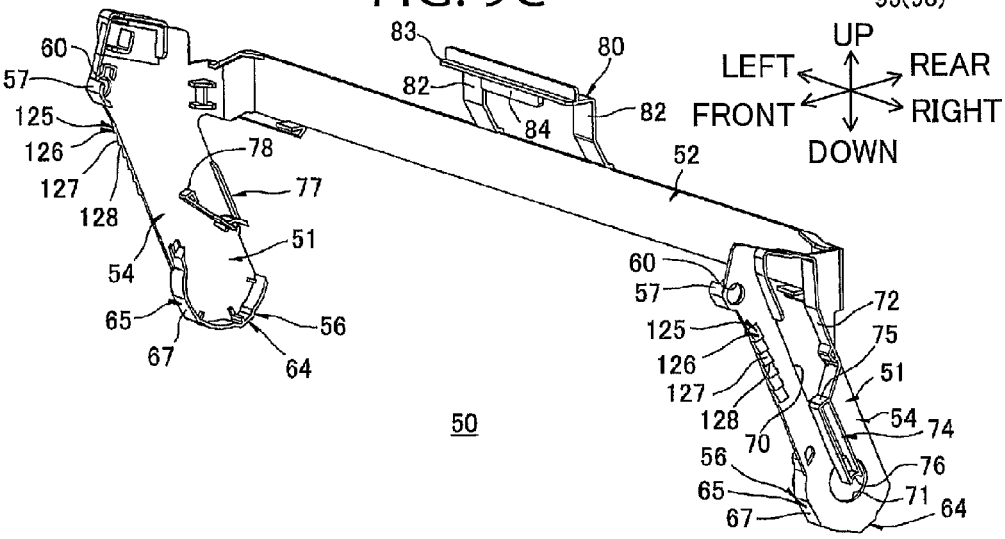
Figure 10A:
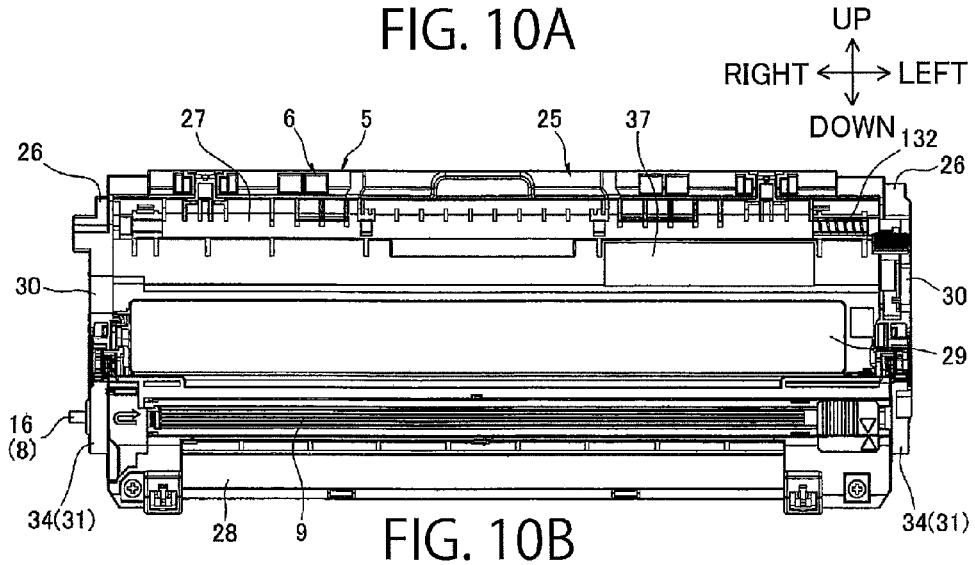
Figure 10B:
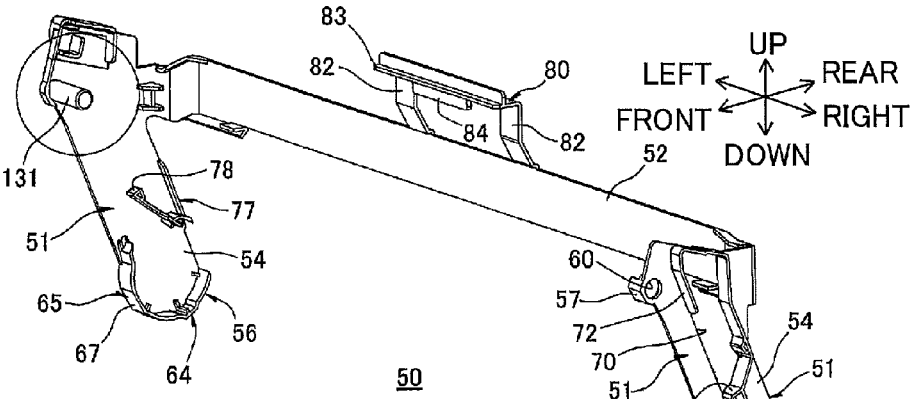
Figure 10C:
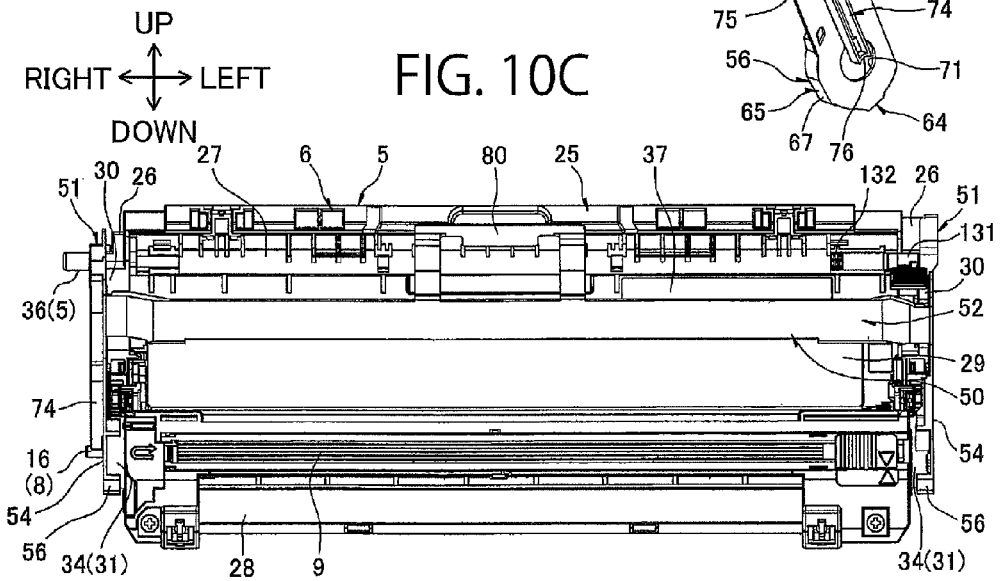

(2) Mounted State of a Process Cartridge in the Main Casing in the Third Embodiment When the Cartridge Cover is Attached When a process cartridge 5 is mounted in the main casing 2 with the cartridge cover 50 attached, as shown in FIG. 9A, the second sliding parts 115 of the urging mechanisms 105 are positioned upstream of the serrated parts 125 of the cartridge cover 50 in the mounting direction of the process cartridge 5 (downstream in the removing direction) and do not contact the serrated parts 125. Therefore, the urging mechanisms 105 are in the second position in which the moving members 109 are positioned on the inside with respect to the left-right direction by the urging force of the spring members 110.

(3) Removing a Process Cartridge from the Main Casing in the Third Embodiment When the Cartridge Cover is Attached To remove the process cartridge 5 from the main casing 2 when the cartridge cover 50 is attached to the process cartridge 5, the user grips the upper portion of the process cartridge 5 and pulls the process cartridge 5 in a direction upward and forward from the main casing 2. During this operation, first the serrated-part sloped surface 127 on the topmost protruding part 126 of the serrated part 125 contacts the sliding-part sloped surface 118 on the second sliding part 115 of the corresponding urging mechanism 105. This contact forces the moving member 109 to move outward in the left-right direction against the urging force of the spring member 110 until the urging mechanism 105 is in the first position.

As the user continues to pull the process cartridge 5 upward and forward, the serrated-part sloped surface 127 slides over and separates from the sliding-part sloped surface 118, allowing the spring member 110 to move the moving member 109 back inward with respect to the left-right direction and to move the urging mechanism 105 back to the second position. Subsequently, the serrated-part sloped surface 127 on the serrated part 125 positioned second from the top in the serrated part 125 contacts the sliding-part sloped surface 118 on the second sliding part 115, moving the urging mechanism 105 back to the first position. This pattern is repeated as the user continues to pull the process cartridge 5 upward and forward. When the serrated-part sloped surface 127 on the lowest protruding part 126 of the serrated part 125 separates from the sliding-part sloped surface 118 on the second sliding part 115, the urging mechanism 105 again returns to the second position. At this point, the process cartridge 5 with the cartridge cover 50 attached has been removed from the main casing 2.

(4) Mounting a Process Cartridge in the Main Casing in the Third Embodiment

To mount a process cartridge 5 in the main casing 2, first the user removes the cartridge cover 50 from the process cartridge 5 according to the same procedure described in the first and second embodiments. Next, the user mounts the process cartridge 5 in the main casing 2 according to the same procedure described in the first embodiment. During this operation, the urging mechanisms 105 remain in the second position and do not contact the process cartridge 5 when the process cartridge 5 is mounted in the main casing 2.

However, it is possible that the user will forget to remove the cartridge cover 50 from the process cartridge 5 before attempting to remount the process cartridge 5 in the main casing 2. If the user attempts to mount a process cartridge 5 in the main casing 2 while the cartridge cover 50 is still attached, the serrated-part orthogonal surfaces 128 on the bottommost protruding parts 126 of the serrated parts 125 will contact the sliding-part orthogonal surfaces 117 on the corresponding second sliding parts 115, as illustrated in FIG. 9B, because the urging mechanisms 105 are in the second position. This contact restricts the process cartridge 5 from being mounted in the main casing 2.

Further, even if the second sliding parts 115 of the moving members 109 succeed in sliding over the bottommost protruding parts 126 on the serrated parts 125, the second sliding parts 115 will contact the second lowest protruding parts 126 on the serrated parts 125. This contact will restrict the user from mounting the process cartridge 5 further in the main casing 2 while the cartridge cover 50 is attached. Accordingly, the structure according to the third embodiment can prevent the process cartridge 5 from being mounted in the main casing 2 while the cartridge cover 50 is attached to the process cartridge 5, ensuring that the user removes the cartridge cover 50 from the process cartridge 5 before remounting the process cartridge 5 in the main casing 2.

(5) Operational Advantages of the Third Embodiment

As illustrated in FIG. 9A, the process cartridges 5 are mounted in the main casing 2 with cartridge covers 50 attached to the process cartridges 5 while the printer 1 according to the third embodiment is shipped and transported. The urging mechanisms 105 are brought into the first position on the way of the process cartridge 5 being removed from the main casing 2, and switch to the second position when the process cartridge 5 has been completely removed.

Therefore, when the user attempts to remount a process cartridges 5 in the main casing 2 in order to use the printer 1 but forgets to remove the cartridge cover 50 from the process cartridge 5, the urging mechanisms 105, now in the second position, will interfere with the cartridge cover 50, restricting the process cartridge 5 from being mounted in the main casing 2.

Thus, once the process cartridge 5 has been removed from the main casing 2, the process cartridge 5 cannot be remounted in the main casing 2 while the cartridge cover 50 is still attached. This configuration reminds the user to remove the cartridge cover 50. Thus, the structure according to the third embodiment can reliably prevent the user from remounting the process cartridge 5 to its mounted position in the main casing 2 while the cartridge cover 50 remains attached to the process cartridge 5.

The printer 1 according to the third embodiment obtains the same operational advantages described in the first embodiment.

9. Fourth Embodiment

Next, a printer 1 according to a fourth embodiment will be described with reference to FIGS. 10A through 11D, wherein like parts and components as those in the first and second embodiments are designated with the same reference numerals to avoid duplicating description.

(1) Structure of the Fourth Embodiment

In the third embodiment described above, serrated parts 125 are provided on the side covers 51. Contact between the serrated parts 125 and urging mechanisms 105 restricts the process cartridge 5 from being mounted in the main casing 2 with the cartridge cover 50 still attached (see FIG. 9B).

However, the serrated parts 125 are not provided on the side covers 51 of the cartridge cover 50 in the fourth embodiment. Instead, the cartridge cover 50 is provided with a protruding part 131 that inserts into the process cartridge 5. The protruding part 131 is provided on the left side cover 51 near the upper front edge of the side-cover body 54. The protruding part 131 has a general columnar shape and protrudes rightward from the right surface of the side-cover body 54. The protruding part 131 is aligned in the left-right direction with the cover-side shaft insertion hole 60 formed in the right side-cover body 54.

A spring member 132 is also provided in the process cartridge 5 according to the fourth embodiment. The spring member 132 is disposed in the left end of the front frame wall 27 constituting the drum cartridge 6. The spring member 132 functions to press the shaft 36 leftward.

The cartridge cover 50 is attached to the process cartridge 5 according to the same procedure described in the first embodiment. At this time, the protruding part 131 is inserted through the shaft insertion hole 33 formed in the left side frame wall 26 of the drum frame 25 and contacts the left endface of the shaft 36. This contact pushes the shaft 36 rightward against the urging force of the spring member 132 until the right end of the shaft 36 protrudes rightward a distance equivalent to the left-right length of the protruding part 131.

Note that the urging mechanism 105 is provided only on the right side wall 90 of the main casing 2 in the fourth embodiment.

Figure 11A:
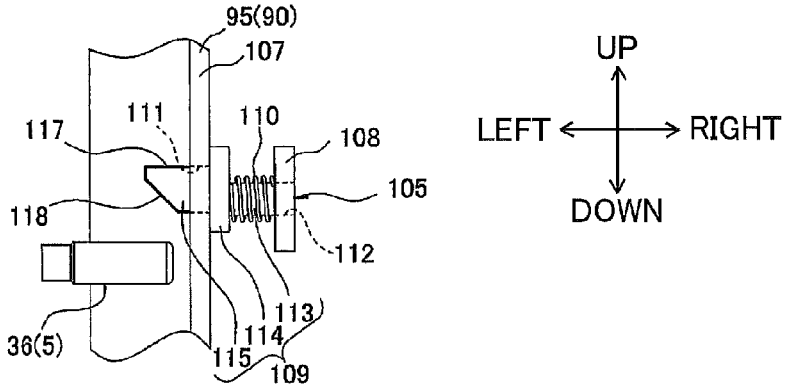

(2) Mounted State of a Process Cartridge in the Main Casing in the Fourth Embodiment When the Cartridge Cover is Attached FIG. 11A shows the process cartridge 5 mounted in the main casing 2 with the cartridge cover 50 attached to the process cartridge 5. The second sliding part 115 in the urging mechanism 105 according to the fourth embodiment is positioned upstream of the right end of the shaft 36 in the direction in which the process cartridge 5 is mounted (downstream in the removing direction) and does not contact the right end of the shaft 36. Accordingly, the urging mechanism 105 is in the second position in which the moving member 109 is urged inward (leftward) by the elastic force of the spring member 110.

Figure 11B:
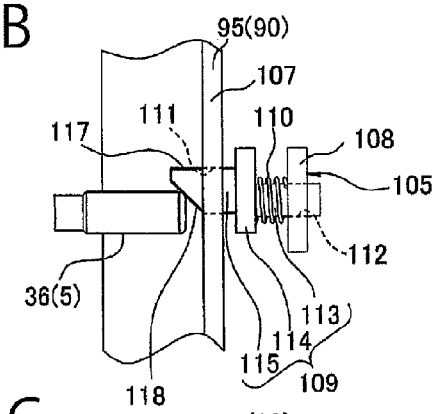
Figure 11C:
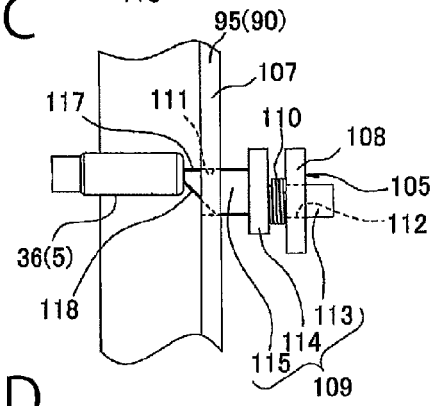

(3) Removing a Process Cartridge from the Main Casing in the Fourth Embodiment When the Cartridge Cover is Attached To remove the process cartridge 5 from the main casing 2 while the cartridge cover 50 is attached to the process cartridge 5, the user grips the upper portion of the process cartridge 5 and pulls the process cartridge 5 diagonally upward and forward from the main casing 2. As the process cartridge 5 is pulled upward, the right end of the shaft 36 contacts the sliding-part sloped surface 118 on the second sliding part 115 of the urging mechanism 105, as illustrated in FIGS. 11B and 11C. This contact forces the moving member 109 rightward against the urging force of the spring member 110 until the urging mechanism 105 is in the first position.

Figure 11D:
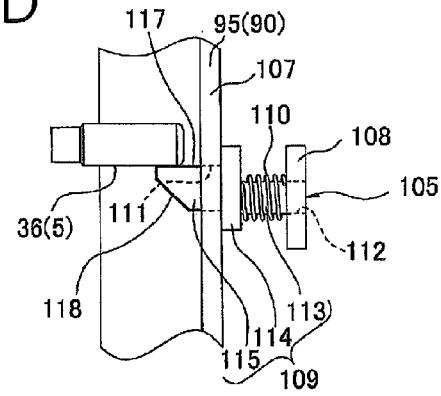

As the user continues to pull the process cartridge 5 upward and forward, the right end of the shaft 36 separates from the sliding-part sloped surface 118, allowing the spring member 110 to move the moving member 109 leftward until the urging mechanism 105 is again in the second position, as illustrated in FIG. 11D. This completes the operation for removing a process cartridge 5 from the main casing 2 while the cartridge cover 50 is still attached.

(4) Mounting a Process Cartridge in the Main Casing in the Fourth Embodiment

To mount the process cartridge 5 in the main casing 2, the user first removes the cartridge cover 50 from the process cartridge 5 according to the same procedure described in the first embodiment. Next, the user mounts the process cartridge 5 into the main casing 2 according to the same procedure described in the first embodiment. Since the cartridge cover 50 has been removed from the process cartridge 5, the protruding part 131 no longer presses the shaft 36 of the process cartridge 5 rightward at this time. Consequently, the elastic force of the spring member 132 pushes the shaft 36 leftward so that the right end of the shaft 36 no longer protrudes from the process cartridge 5. As a result, the urging mechanism 105 remains in the second position and does not contact the right end of the shaft 36 when the process cartridge 5 is mounted in the main casing 2.

However, it is conceivable that the user could forget to remove the cartridge cover 50 from the process cartridge 5 and attempt to remount the process cartridge 5 in the main casing 2. If the user attempts to remount the process cartridge 5 in the main casing 2 while the cartridge cover 50 is still attached, the right end of the shaft 36 will contact the sliding-part orthogonal surface 117 on the second sliding part 115, as illustrated in FIG. 11D, since the urging mechanism 105 is in the second position.

This contact restricts the user from mounting the process cartridge 5 into the main casing 2. Accordingly, the structure according to the fourth embodiment can prevent the user from mounting a process cartridge 5 in the main casing 2 while the cartridge cover 50 is still attached to the process cartridge 5, ensuring that the user removes the cartridge cover 50 prior to remounting the process cartridge 5.

(5) Operational Advantages of the Fourth Embodiment

In the fourth embodiment shown in FIGS. 10A-11D, the right end of the shaft 36 protrudes from the process cartridge 5 when the cartridge cover 50 is attached to the process cartridge 5 and interferes with the urging mechanism 105 in the second position when the process cartridge 5 is being mounted in the main casing 2. Hence, the process cartridge 5 rather than the cartridge cover 50 interferes with the urging mechanism 105, reliably preventing the process cartridge 5 from being mounted into its mounted position in the main casing 2 while the cartridge cover 50 is still attached.

As shown in FIGS. 11A-11D, the urging mechanism 105 in the fourth embodiment becomes in the first position only on the way of the process cartridge 5 being removed from the main casing 2 with the cartridge cover 50 attached. In other words, the urging mechanism 105 is in the second position while the process cartridge 5 is mounted in the main casing 2 with the cartridge cover 50 attached. Since the urging mechanism 105 does not contact the cartridge cover 50 or the process cartridge 5 when in the second position, the printer 1 according to the fourth embodiment can be shipped and transported without applying external force to the urging mechanism 105. This configuration can maintain the urging mechanism 105 in good condition.

As shown in FIG. 11A-11D, the urging mechanism 105 according to the fourth embodiment is provided on at least one of the left and right ends of the cartridge cover 50 and is disposed in the second position when the process cartridge 5 has been removed from the main casing 2. By providing the urging mechanism 105 on at least one side of the process cartridge 5 so as to be disposed in the second position when the process cartridge 5 has been removed from the main casing 2, this simple construction of having an urging mechanism 105 in the second position can prevent the process cartridge 5 from being remounted to its mounted position in the main casing 2 while the cartridge cover 50 is still attached. The process cartridge 5 can be mounted in the main casing 2 after removing the cartridge cover 50 from the process cartridge 5.

The printer 1 according to the fourth embodiment can obtain the same operational advantages described in the first embodiment.

10. Fifth Embodiment

Next, a printer 1 according to a fifth embodiment will be described with reference to FIGS. 12 through 14D, wherein like parts and components as those in the first through fourth embodiments are designated with the same reference numerals to avoid duplicating description.

(1) Structure of the Fifth Embodiment

In the first through fourth embodiments described above, the cartridge cover 50 is mounted over the process cartridge 5 when packaging the printer 1, and the process cartridge 5 is restricted from being remounted in the main casing 2 while the cartridge cover 50 is still attached (see FIGS. 5B, 8B, 9B, and 11D).

The printer 1 according to the fifth embodiment includes process cartridges 140. A sealing member 134 is mounted in each process cartridge 140, and the process cartridges 140 are mounted inside the main casing 2 for shipping and transport.

(1-1) Structure of the Process Cartridges

Figure 12:
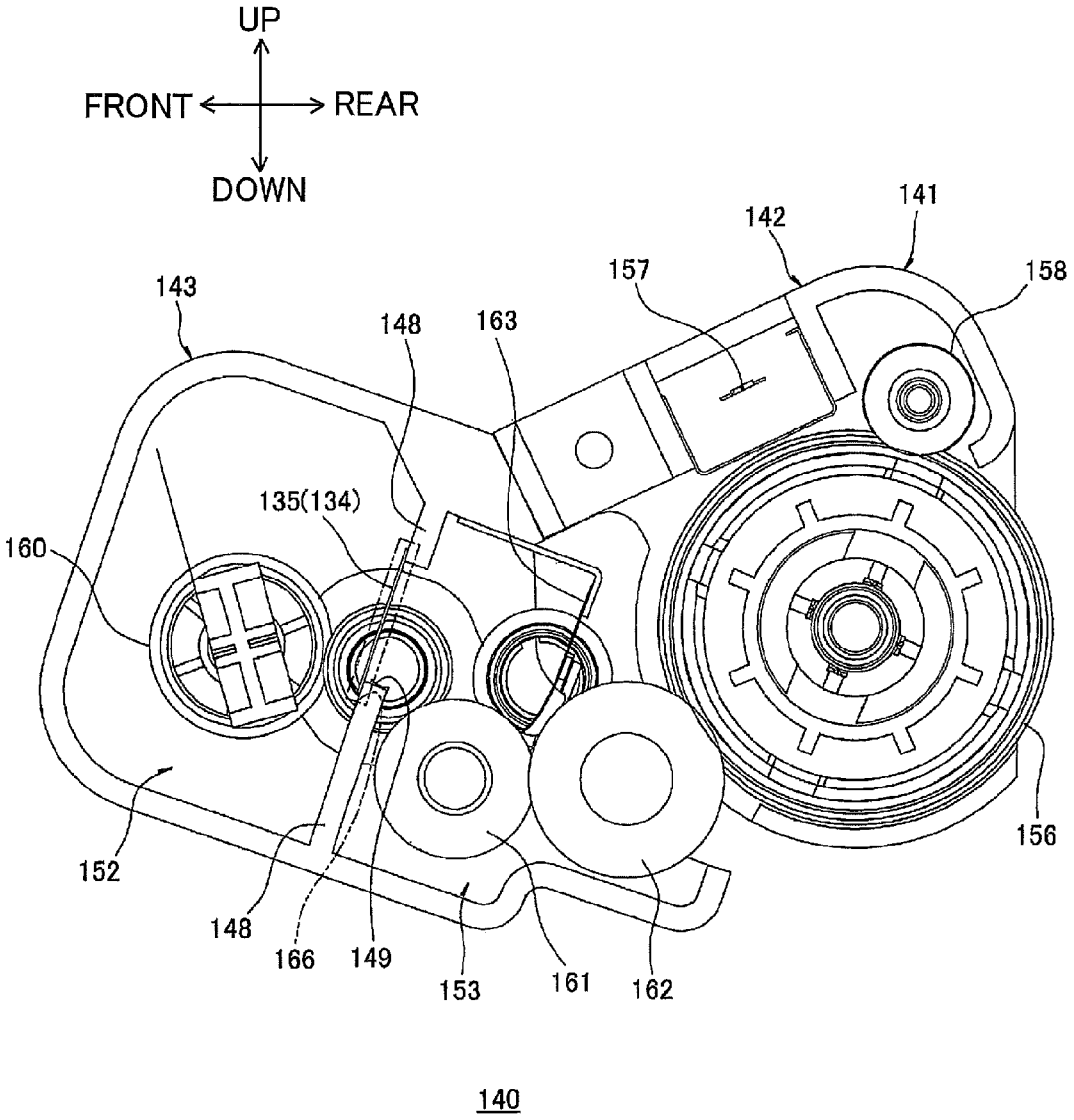
FIG. 12 is a cross-sectional side view of a process cartridge according to a fifth embodiment.

As shown in FIG. 12, the process cartridge 140 has a cartridge frame 141. The cartridge frame 141 includes a developing case 143, and a drum-retaining unit 142.

The developing case 143 constitutes the front portion of the cartridge frame 141 and has a box-like shape with an opening on the rear side. The interior of the developing case 143 is partitioned in the front-rear direction by partitioning walls 148 into a toner-accommodating chamber 152 and a developing chamber 153.

The partitioning walls 148 are provided one on the top wall and one on the bottom wall of the developing case 143. The partitioning walls 148 protrude into the developing case 143 and toward each other, but are separated by a gap. The gap formed between the partitioning walls 148 defines a through-hole 149.

The toner-accommodating chamber 152 constitutes the front interior region of the developing case 143 and functions to accommodate toner. An agitator 160 is disposed in the general vertical and front-rear center region of the toner-accommodating chamber 152.

The developing chamber 153 constitutes the rear interior region of the developing case 143 on the rear side of the partitioning walls 148. The developing chamber 153 is in communication with the toner-accommodating chamber 152 through the through-hole 149. The developing chamber 153 accommodates a supply roller 161, a developing roller 162, and a thickness-regulating blade 163.

The supply roller 161 is rotatably disposed in the lower front region of the developing chamber 153.

The developing roller 162 is rotatably disposed in the lower rear region of the developing chamber 153. The developing roller 162 is positioned to contact the rear side of the supply roller 161, while the upper rear side of the developing roller 162 is exposed outside the developing chamber 153.

The thickness-regulating blade 163 is fixed by its top edge to the rear edge on the top wall of the developing chamber 153. The lower edge of the thickness-regulating blade 163 is in contact with the front side of the developing roller 162.

Figure 13A:
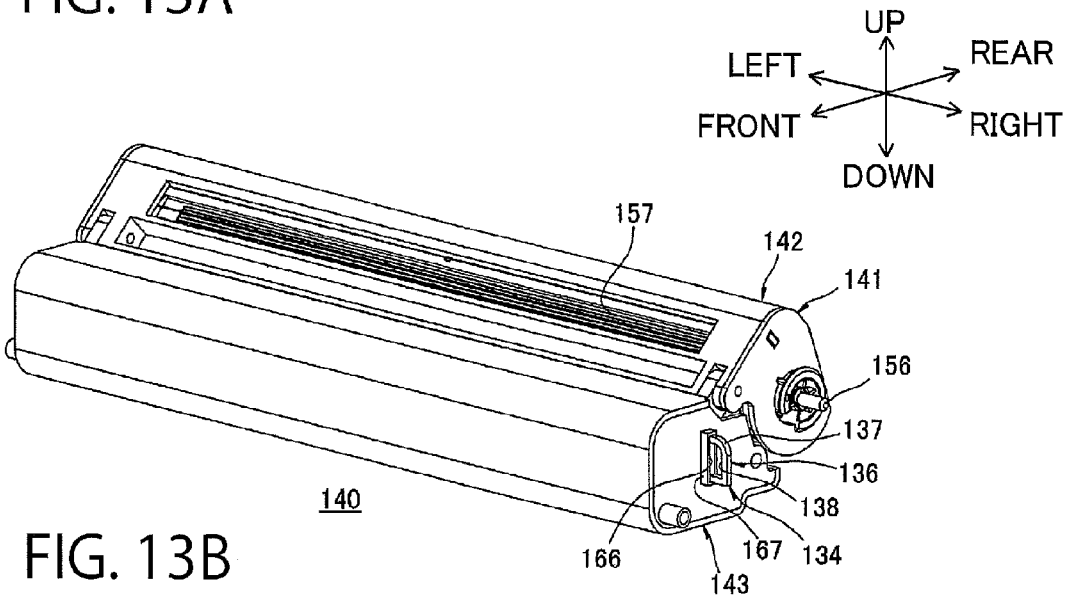
Figure 13B:
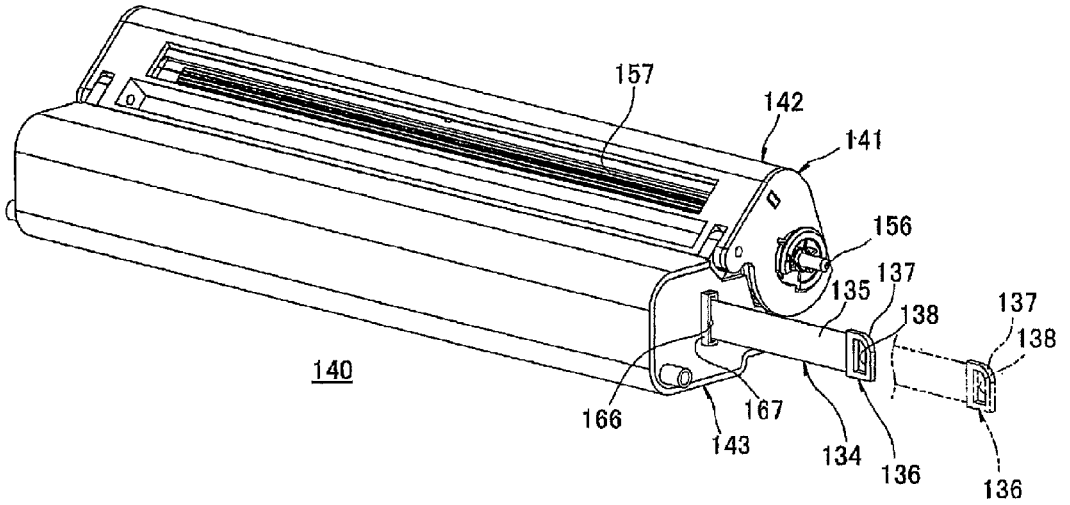

As shown in FIGS. 13A and 13B, a seal insertion hole 166 is formed in the right wall of the developing case 143, and a strap-retaining part 167 is provided on the right wall of the developing case 143 around the periphery of the seal insertion hole 166.

The seal insertion hole 166 is formed in a general rectangular shape from a side perspective and penetrates the right wall of the developing case 143 in an area that is aligned, in the left-right direction, with the front surfaces of the partitioning walls 148 at the vertically inner parts of the same.

The strap-retaining part 167 is generally shaped like a square cylinder and protrudes rightward from the peripheral edge of the seal insertion hole 166.

As shown in FIG. 12, the drum-retaining unit 142 constitutes the rear portion of the cartridge frame 141, extending from the rear side of the developing case 143 above the opening formed therein in a direction diagonally upward and rearward therefrom. The drum-retaining unit 142 is supported so as to be capable of pivoting relative to the developing case 143. The drum-retaining unit 142 has a substantially rectangular frame-like shape with a closed top. The drum-retaining unit 142 retains a photosensitive drum 156, a scorotron charger 157, and a cleaning roller 158. The photosensitive drum 156 is arranged to contact the upper rear side of the developing roller 162. The scorotron charger 157 is positioned to confront the upper front side of the photosensitive drum 156. The cleaning roller 158 contacts the upper rear side of the photosensitive drum 156.

(1-2) Structure of the Sealing Member

The sealing member 134 includes a seal 135, and a grip 136.

The seal 135 is formed of polyethylene terephthalate or the like, and has a sheet-like shape that is generally rectangular in a front view. The vertical dimension of the seal 135 is greater than that of the through-hole 149 (see FIG. 12), while its left-right dimension is approximately equal to the left-right dimension of the through-hole 149.

The grip 136 is fixed to the right end of the seal 135. The grip 136 has a flat plate shape that is generally rectangular in a front view, with a greater front-rear dimension than the seal 135. The grip 136 includes an arc-shaped part 137, and a grip hole 138.

The arc-shaped part 137 is formed to appear that the upper right corner of the grip 136 has been cut into a general arc shape.

The grip hole 138 has a general rectangular shape in a front view and penetrates the approximate vertical and left-right center region of the grip 136.

The sealing member 134 is mounted in the process cartridge 5 with the seal 135 blocking the through-hole 149 from the front side and contacting the front surfaces of the partitioning walls 148 at the vertically inner parts of the same, as shown in FIG. 12. The grip 136 is fitted into the strap-retaining part 167 from the right side thereof and retained in the strap-retaining part 167, as illustrated in FIG. 13A. These components prevent toner from being supplied from the toner-accommodating chamber 152 to the developing chamber 153.

Figure 14A:
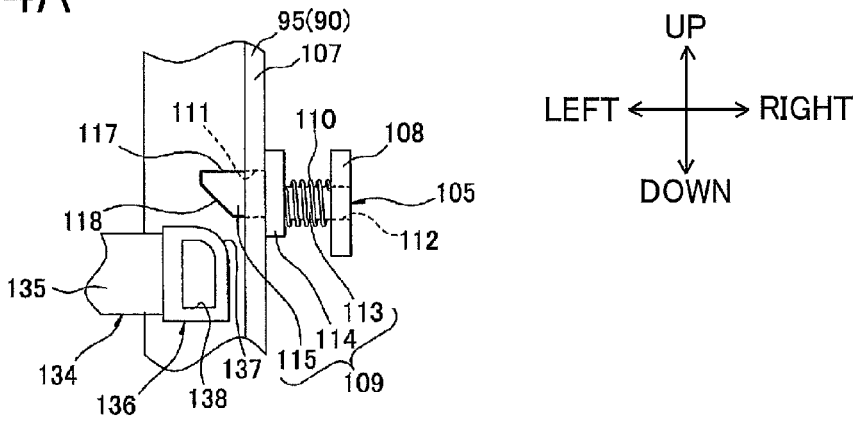

(2) Mounted State of a Process Cartridge in the Main Casing in the Fifth Embodiment When the Sealing Member is Inserted FIG. 14A shows the process cartridge 140 mounted in the main casing 2 while the sealing member 134 is inserted in the process cartridge 140. In this state, the second sliding part 115 of the urging mechanism 105 is positioned upstream of the grip 136 with respect to the direction in which the process cartridge 140 is mounted (downstream in the removing direction) and does not contact the grip 136. Accordingly, the urging mechanism 105 is disposed in the second position in which the moving member 109 is positioned inward (leftward) by the urging force of the spring member 110.

Since the process cartridge 140 is mounted in the main casing 2 with the sealing member 134 mounted in the process cartridge 140 while the printer 1 is packaged for shipping and transport, the sealing member 134 can prevent toner from being supplied from the toner-accommodating chamber 152 to the developing chamber 153 due to vibrations or impacts occurring during shipping and transport.

Figure 14B:
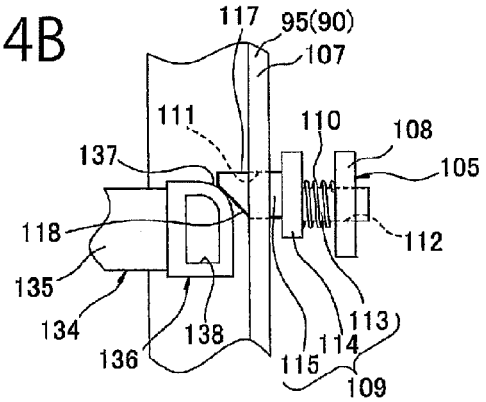
Figure 14C:
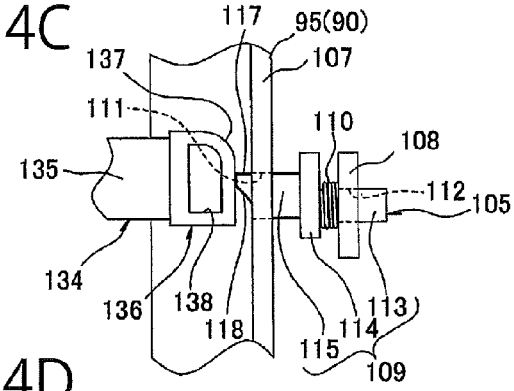

(3) Removing a Process Cartridge from the Main Casing in the Fifth Embodiment When the Sealing Member is Inserted To remove the process cartridge 140 from the main casing 2 while the sealing member 134 is inserted in the process cartridge 140, the user grips the upper portion of the process cartridge 5 and pulls the process cartridge 5 out of the main casing 2 in a direction obliquely upward and forward. As the process cartridge 5 is being pulled out of the main casing 2, the arc-shaped part 137 of the sealing member 134 contacts the sliding-part sloped surface 118 on the second sliding part 115 of the urging mechanism 105, as illustrated in FIG. 14B. This contact forces the moving member 109 rightward against the elastic force of the spring member 110 until the urging mechanism 105 is in the first position, as illustrated in FIG. 14C.

Figure 14D:
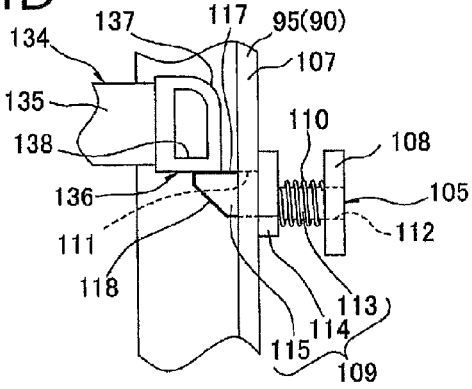

As the user continues to pull the process cartridge 140 upward and forward, the arc-shaped part 137 of the sealing member 134 separates from the sliding-part sloped surface 118, allowing the spring member 110 to move the moving member 109 leftward, as illustrated in FIG. 14D. At this time, the urging mechanism 105 is once again in the second position. This completes the operation to remove the process cartridge 5 from the main casing 2 while the sealing member 134 is mounted in the process cartridge 5.

(4) Mounting a Process Cartridge in the Main Casing in the Fifth Embodiment

To mount the process cartridge 140 in the main casing 2, the user first removes the sealing member 134 from the process cartridge 140. To remove the sealing member 134, the user grips the grip 136 of the sealing member 134 and pulls the sealing member 134 rightward. By removing the sealing member 134, the through-hole 149 is unobstructed, enabling toner to be supplied from the toner-accommodating chamber 152 to the developing chamber 153.

Next, the user mounts the process cartridge 140 in the main casing 2 according to the same procedure described in the first embodiment. At this time, the urging mechanism 105 remains in the second position and does not contact the process cartridge 140 when the process cartridge 140 is mounted in the main casing 2.

However, it is conceivable that the user may forget to remove the sealing member 134 from the process cartridge 140 and attempt to remount the process cartridge 140 in the main casing 2 while the sealing member 134 is still mounted therein. However, since the urging mechanism 105 is disposed in the second position at this time, the bottom surface of the grip 136 will contact the sliding-part orthogonal surface 117 of the second sliding part 115 when the process cartridge 140 is being mounted in the main casing 2, thereby restricting the process cartridge 140 from being mounted. Thus, the configuration according to the fifth embodiment can prevent the process cartridge 140 from being remounted in the main casing 2 while the sealing member 134 is still inserted in the process cartridge 140, ensuring that the user removes the sealing member 134 before performing the remounting operation.

(5) Operational Advantages of the Fifth Embodiment

In the fifth embodiment, the sealing member 134 is removed from the process cartridge 140 by pulling the sealing member 134 by the grip 136, as illustrated in FIG. 13B. Therefore, if the user attempts to remount the process cartridge 140 in the main casing 2 in order to use the printer 1 but forgets to remove the sealing member 134 from the process cartridge 140, the urging mechanism 105 will interfere with the grip 136 of the sealing member 134, restricting the process cartridge 140 from being mounted into its mounted position in the main casing 2. Since the process cartridge 140 cannot be remounted in the main casing 2 while the sealing member 134 remains in the process cartridge 140, the structure according to the fifth embodiment reminds the user that the sealing member 134 has not been removed. Hence, this structure reliably prevents the process cartridge 140 from being remounted into its mounted position inside the main casing 2 while the sealing member 134 remains in the process cartridge 140.

The printer 1 according to the fifth embodiment obtains the same operational advantages described in the first embodiment.

11. Sixth Embodiment

Figure 15:
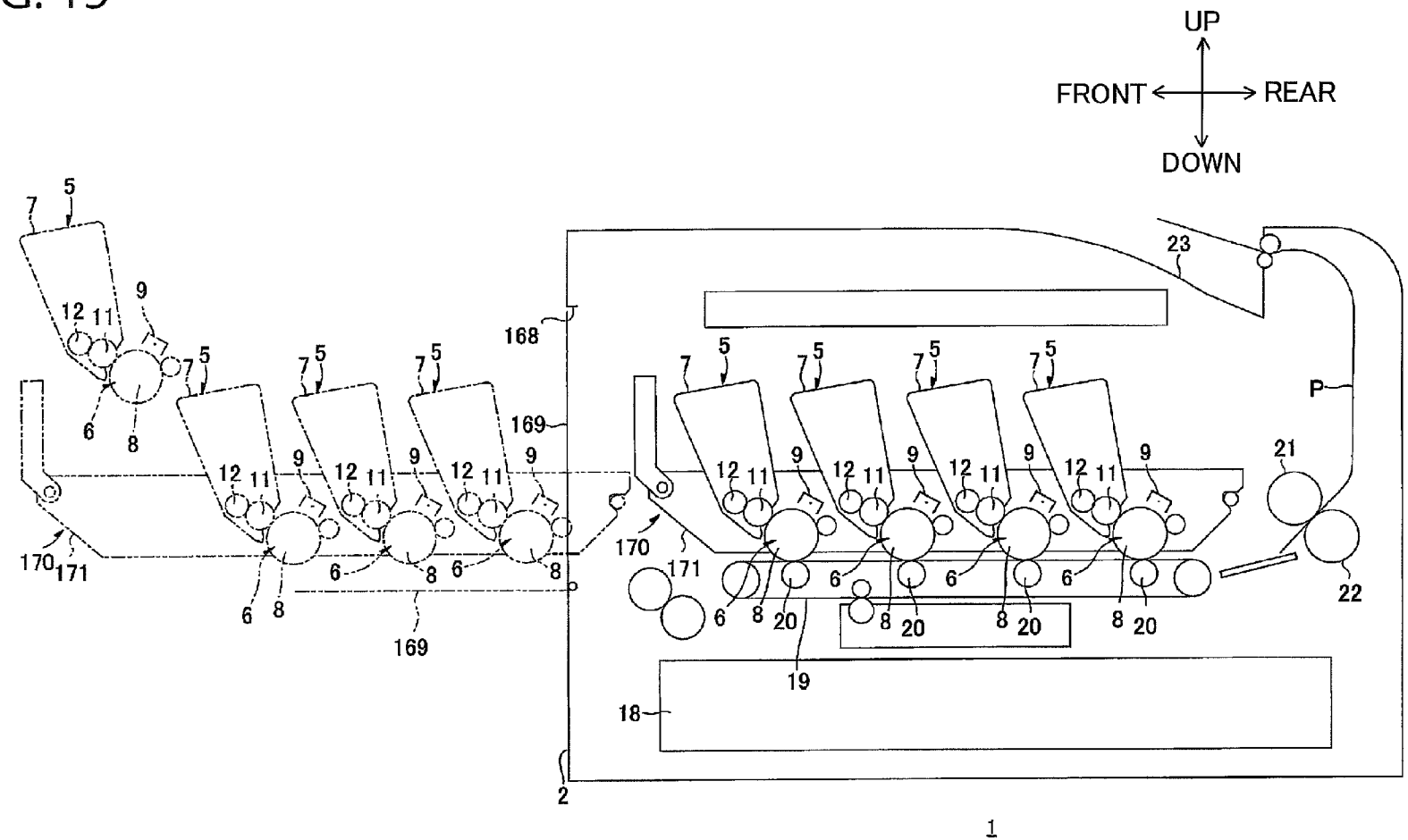
FIG. 15 is a cross-sectional side view of a printer according to a sixth embodiment of the present invention.

Next, a printer 1 according to a sixth embodiment of the present invention will be described with reference to FIG. 15, wherein like parts and components as those in the first through fourth embodiments are designated with the same reference numerals to avoid duplicating description.

In the first through fourth embodiments described above, the process cartridges 5 are detachably mounted in the main casing 2 through the access opening 3. When the printer 1 is shipped and transported, the process cartridges 5 are provided inside the main casing 2 with the cartridge covers 50 attached to the process cartridges 5.

In the sixth embodiment of the present invention, the main casing 2 includes a drawer unit 170. An access opening 168 is formed in the front side of the main casing 2 for mounting the drawer unit 170 in and removing the drawer unit 170 from the main casing 2. A front cover 169 is provided on the front of the main casing 2 and is capable of pivoting about its lower edge for exposing and covering the access opening 168.

The drawer unit 170 can slide freely relative to the main casing 2 in the front and rear directions to be mounted therein or removed therefrom. The drawer unit 170 also includes a drawer frame 171, and a plurality of (four) process cartridges 5.

The drawer frame 171 is a frame-like structure that is generally rectangular in a plan view and is open on the top and bottom sides.

The process cartridges 5 are detachably mounted in the drawer frame 171 at intervals in the front-rear direction. When the process cartridges 5 are mounted in the drawer frame 171, the bottom ends of the photosensitive drums 8 are exposed through the opening in the bottom of the drawer frame 171.

When the printer 1 is packaged for shipping and transport, the process cartridges 5 are mounted in the drawer frame 171 in such a state that the process cartridges 5 are attached with the cartridge covers 50 described in any of the first through fourth embodiments, and the drawer frame 171 is mounted inside the main casing 2. In order to use the printer 1, the user must remove the cartridge covers 50 from the process cartridges 5 and remount the process cartridges 5 in the drawer frame 171.

If the user forgets to remove the cartridge cover 50 from a process cartridge 5 and attempts to remount the process cartridge 5 in the drawer frame 171, the process cartridge 5 is restricted from being mounted in the drawer frame 171 while the cartridge cover 50 is still attached, as described in the first through fourth embodiments.

Accordingly, the structure described in the sixth embodiment can prevent the process cartridges 5 from being remounted in the drawer frame 171 while the cartridge covers 50 are still attached, ensuring that the user first removes the cartridge covers 50 from the process cartridges 5.

The printer 1 according to the sixth embodiment can obtain the same operational advantages described in the first through fourth embodiments.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a frame;

a cartridge configured to be detachably mounted in the frame, the cartridge being located at a mounted position in the frame when the image forming apparatus is packaged with the cartridge mounted in the frame, the mounted position being defined in the frame in a mounting direction, in which the cartridge moves relative to the frame so as to be mounted in the frame;

an attachment member configured to be detachably attached to the cartridge when the image forming apparatus is packaged with the cartridge mounted in the frame; and a restricting mechanism configured to allow the cartridge attached with the attachment member to be moved in a removing direction that is opposite to the mounting direction, to thereby allow the cartridge attached with the attachment member to be removed from the frame, the restricting mechanism being further configured to restrict mounting of the cartridge to the mounted position when the cartridge attached with the attachment member is to be remounted in the frame after the cartridge attached with the attachment member has been removed from the frame, the restricting mechanism restricting the mounting of the cartridge attached with the attachment member at a position that is upstream of the mounted position in the mounting direction.

2. The image forming apparatus according to claim 1, wherein:

the attachment member includes the restricting mechanism, the restricting mechanism is configured to shift between a first position and a second position different from the first position, while the attachment member is being attached to the cartridge, the restricting mechanism being in the first position when the cartridge attached with the attachment member is located at the mounted position in the frame, and is configured to shift to the second position upon removal of the cartridge attached with the attachment member from the frame, and the restricting mechanism in the second position is configured to interfere with the frame when the cartridge attached with the attachment member is to be remounted in the frame after the cartridge attached with the attachment member having been removed from the frame.

3. The image forming apparatus according to claim 2, wherein the restricting mechanism is integrally formed with the attachment member.

4. The image forming apparatus according to claim 1, wherein:

the frame includes the restricting mechanism, the restricting mechanism is configured to be in a first position when the cartridge attached with the attachment member is located at the mounted position in the frame, and to shift to a second position when the cartridge attached with the attachment member is removed from the frame, and the restricting mechanism in the second position is configured to interfere with the attachment member when the cartridge attached with the attachment member is to be remounted in the frame after being removed from the frame.

5. The image forming apparatus according to claim 1, wherein:

the frame includes the restricting mechanism, the restricting mechanism is configured to be in a first position as the cartridge attached with the attachment member is removed from the frame, and to be in a second position when the cartridge attached with the attachment member has completely removed from the frame, and the restricting mechanism in the second position is configured to interfere with either one of the attachment member and the cartridge when the cartridge attached with the attachment member is to be remounted in the frame after being removed from the frame.

6. The image forming apparatus according to claim 5, wherein the cartridge includes a protrusion that is configured to protrude outwardly of the cartridge when the attachment member is attached to the cartridge, and wherein the restricting mechanism in the second position is configured to interfere with the protrusion when the cartridge attached with the attachment member is to be remounted in the frame after being removed from the frame.

7. The image forming apparatus according to claim 5, wherein the restricting mechanism is configured to shift to the first position by contacting either one of the cartridge and the attachment member as the cartridge attached with the attachment member is removed from the frame, and to be in the second position when the restricting mechanism is out of contact with the cartridge and the attachment member.

8. The image forming apparatus according to claim 1, wherein the restricting mechanism is configured to restrict the mounting of the cartridge at the position that is upstream of the mounted position in the mounting direction and that is defined with respect to at least one of a pair of opposite sides of the attachment member attached to the cartridge, the pair of opposite sides being defined in a perpendicular direction perpendicular to the mounting direction.

9. The image forming apparatus according to claim 1, wherein:

the cartridge includes a developer accommodating chamber and a developing chamber, and the attachment member includes a sealing member configured to prevent developer from being supplied from the developer accommodating chamber to the developing chamber.

10. The image forming apparatus according to claim 1, wherein the attachment member is elastically deformable.

11. The image forming apparatus according to claim 1, wherein:

the cartridge includes:

a developer bearing body; and a photosensitive body configured to be disposed in confrontation with the developer bearing body, and the attachment member is configured to cause the developer bearing body and the photosensitive body to be spaced apart from each other when the cartridge attached with the attachment member is mounted in the frame.

12. The image forming apparatus according to claim 1, wherein:

the cartridge includes a photosensitive body, the image forming apparatus further comprises a belt configured to be disposed in confrontation with the photosensitive body when the cartridge is mounted in the frame, and the attachment member is configured to cause the photosensitive body and the belt to be spaced apart from each other when the cartridge attached with the attachment member is mounted in the frame.

13. The image forming apparatus according to claim 1, wherein the frame is provided with the restricting mechanism at the position that is upstream of the mounted position in the mounting direction and that is defined with respect to at least one of a pair of opposite sides of the attachment member attached to the cartridge to be mounted to the mounting position, the pair of opposite sides being defined in a perpendicular direction perpendicular to the mounting direction.

* * * * *